United States Patent [19]

Codina et al.

[11] 4,170,735

[45] Oct. 9, 1979

[54] PORTABLE X-RAY UNIT

[75] Inventors: Jorge G. Codina, Hartsdale, N.Y.; Weems E. Estelle, Southport; Gerald J. Stussman, Orange, both of Conn.

[73] Assignee: General X-Ray Corporation, Southport, Conn.

[21] Appl. No.: 817,788

[22] Filed: Jul. 21, 1977

[51] Int. Cl.[2] ..... H05G 1/10

[52] U.S. Cl. ..... 250/422; 250/413; 250/402

[58] Field of Search ..... 250/401, 402, 408, 409, 250/413, 416, 421, 422

[56] References Cited

U.S. PATENT DOCUMENTS

| | | | |
|---|---|---|---|
| 2,894,143 | 7/1959 | Graves | 250/422 |
| 3,406,286 | 10/1968 | Bross | 250/413 |
| 3,971,946 | 7/1976 | Craig et al. | 250/422 |

*Primary Examiner*—Bruce C. Anderson

*Attorney, Agent, or Firm*—Mattern, Ware, Davis & Stoltz

[57] ABSTRACT

By providing a hand-held remote controller capable of controlling, at a low voltage level, all operational functions of an X-ray generating module with all high voltage lines contained within the main housing, a portable X-ray unit is achieved having both mobility and flexibility. This is chiefly attained by employing kVp line selection in the remote controller with high speed solid state switching in the main housing for energizing the desired windings in the high voltage transformer, and digital control of the current in the remote controller for delivery to the filament transformer of the X-ray tube. The filament current to the X-ray tube, which is automatically varied as a function of the kVp level and exposure time selected, is controlled by changing the frequency of the pulse delivered to the filament transformer. The particular current level being employed is automatically determined by the system, to assure maximum power utilization of the X-ray tube within its heat dissipation capabilities. In this way, a low power and lightweight X-ray tube is used with maximum power capabilities and long life. In the preferred embodiment, the X-ray unit incorporates a sealed X-ray generating module, containing the X-ray tube and the high voltage transformers, which is entirely replaceable quickly and easily when necessary, thereby allowing replacement by unskilled personnel.

36 Claims, 13 Drawing Figures

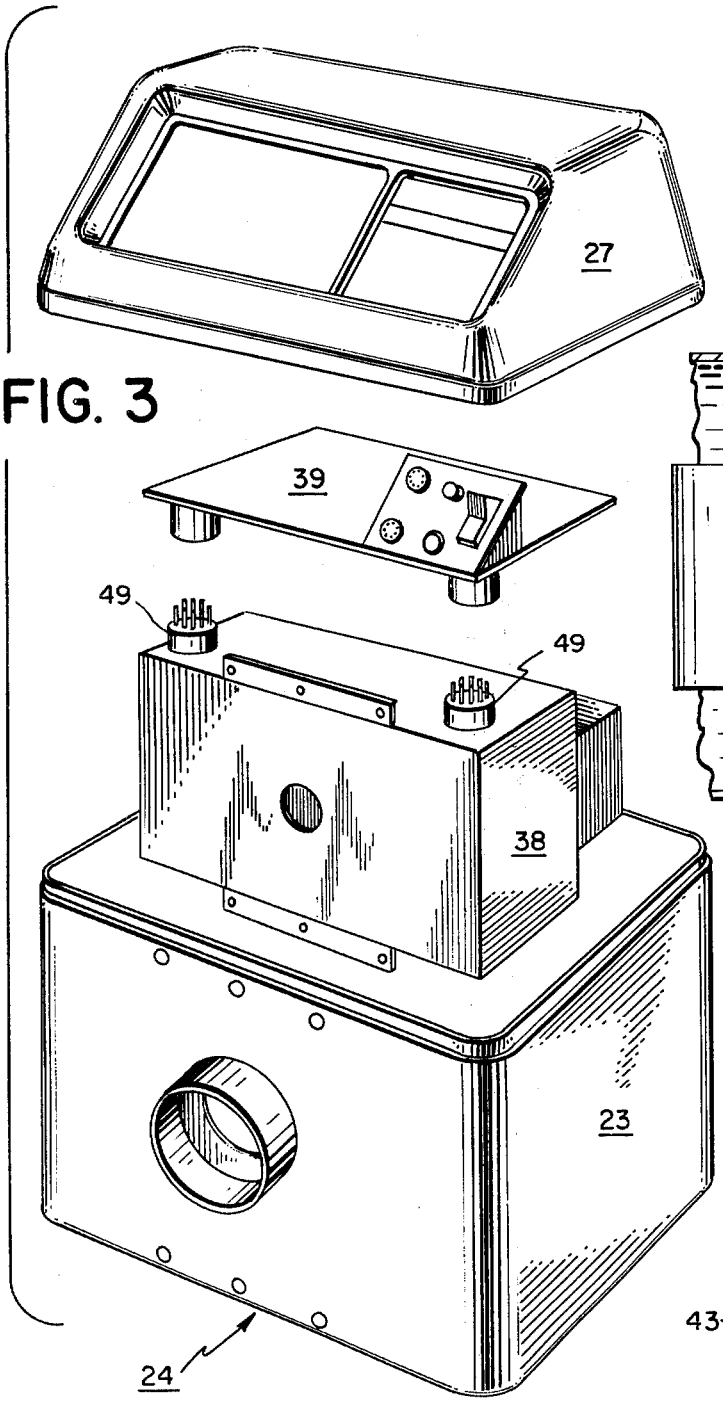
FIG. 3
FIG. 5
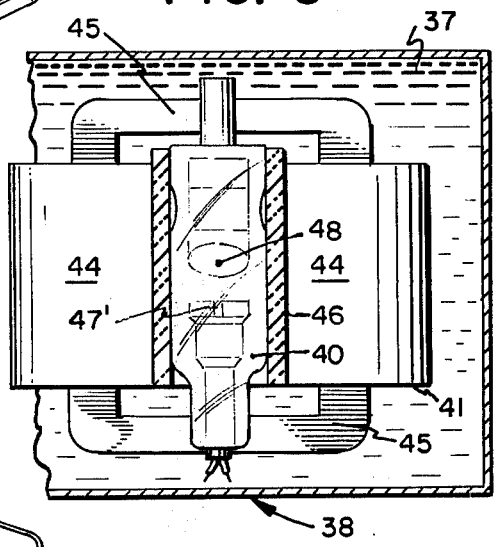
FIG. 4
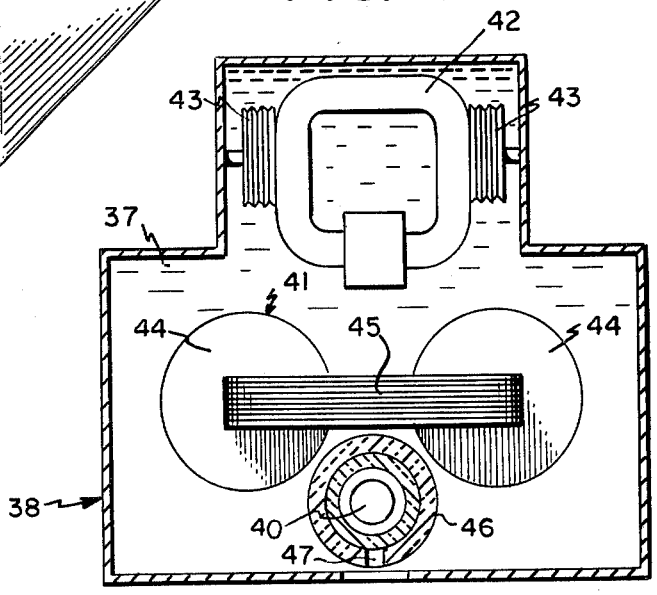

33K
77
76
2.2K
+Vcc
81
80
10K
10K
10
+Vcc
1.5K
FILAMENT
68
.01
.33μfd
22μf @ 6V
680Ω
2 SEC. UP TO 4 SEC.
680Ω
1.0K
3 SEC. UP TO 1.8 SEC.
1.5K
1/120 SEC. UP TO .3 SEC.
29 (SECTION "B")
5K
5K
5K
5K
5K
28 (SECTION "B")
34
470Ω
+Vcc
470Ω
1.5K
470Ω
MA-WARM UP
70
10K
RESET
470K
3.3
+Vcc
MA-ON
71
150K
100μfd
+Vcc

PORTABLE X-RAY UNIT

BACKGROUND OF THE INVENTION

This invention relates to X-ray units and more particularly to portable X-ray units.

In general, prior art X-ray units are extremely cumbersome and are not capable of easy movement from one location to another location. Consequently, either patients are forced to be moved to the X-ray unit, or additional, possibly unnecessary, X-ray units are purchased.

Furthermore, prior art X-ray units are incapable of providing the operator with a single hand-held device with which all of the operating functions of the X-ray unit can be controlled at a position remote from the actual X-ray production. As a result, the operator is often unaware of operational malfunctions which occur in the main unit.

Another disadvantage commonly found in prior art portable X-ray units is their inability to provide a broad range of selections for X-ray exposure times. Generally, only large, stationary X-ray systems have broad ranges of exposure time available.

Presently, most portable X-ray units are comparatively large and cumbersome, difficult to quickly and easily move from one location to another, and also very expensive. Furthermore, X-ray leakage around the periphery of the tube tends to be comparatively high, resulting in the necessity for incorporating heavy shielding around the tube to reduce this unwanted potential X-ray exposure.

Another problem commonly found in prior art units is that the longevity of the X-ray tube is short, and highly trained personnel are required to change the X-ray tube since high voltage lines are being dealt with. Consequently, down-time for tube replacement is high, which presents a considerable problem when systems are actively in use.

Therefore, it is a principal object of this invention to provide a portable X-ray unit which is lightweight, quickly and easily movable, and has an extremely low X-ray leakage.

Another object of the present invention is to provide a portable X-ray unit having the characteristic features defined above while also providing a hand-held remote controller capable of providing the operator with complete control over all operational functions of the main unit, with complete knowledge of the entire unit's operation.

Another object of the present invention is to provide an X-ray unit having the characteristic features defined above while also beng capable of maintaining a broad range of precise exposure times.

A further object of the present invention is to provide an X-ray unit having the characteristic features defined above which is quickly and easily operated by any individual having minimum training in X-ray operations.

Another object of the present invention is to provide a portable X-ray unit having the characteristic features defined above which provides consistent, accurate, reproducible results with a maximum of safety.

A further object of the present invention is to provide a portable X-ray unit having the characteristic features defined above which also incorporates safety features for protecting against potential operator error.

Another object of the present invention is to provide a portable X-ray unit having the characteristic features defined above which incorporates a small, low power X-ray tube and provides a controlled maximum power output from the tube.

Another object of the present invention is to provide a portable X-ray unit having the characteristic features defined above in which the X-ray tube achieves a comparatively long life.

Another object of the present invention is to provide a portable X-ray unit having the characteristic features defined above which incorporates an X-ray generator capable of replacement by unskilled personnel.

Other and more specific objects will in part be obvious and will in part appear hereinafter.

SUMMARY OF THE INVENTION

By employing a low power X-ray tube with a kVp level selector in a hand-held remote controller having solid state switching devices in the main housing for energizing the desired high voltage transformer windings and automatically controlled precise digital control of the filament power supply, an extremely lightweight, full performance portable X-ray unit is achieved. The portable X-ray unit of the present invention incorporates a hand-held remote controller which provides the operator with complete control over all operational functions of the X-ray generator module while also providing the operator with full knowledge of the system's operation.

Another feature of the X-ray unit of the present invention is the incorporation of a sealed X-ray generating module which contains the X-ray tube, the high voltage transformer and the filament transformer. Preferably, the X-ray tube is mounted between the windings of the high voltage transformer. In this way, unwanted X-ray leakage is substantially reduced without requiring conventional heavy lead shielding panels.

The positioning of the X-ray tube between the high voltage transformer windings has another extremely advantageous result, namely a pre-focusing of the electron beam. Although the actual mechanism is not known, it is believed that the magnetic fields surrounding the high voltage transformer windings cooperate to pre-focus the electrons flowing from the filament to the target. As a result, the X-ray tube achieves a more concentrated electron beam at higher mA levels than the rated beam size at substantially lower mA levels. Therefore, the X-ray tube of the present invention maintains a small focal spot even with increasing current levels, achieving maximum resolution with no compromise in power.

The X-ray tube itself is preferably a low power, small-size tube. However, due to the positioning of the tube and the mA level control which automatically maximizes the power to the tube, a lightweight, compact system is achieved which provides output levels previously only obtainable in larger and much heavier X-ray units. In the X-ray unit of the present invention, weight is held to a minimum, while the output power and X-ray capabilities are maximized.

Another feature of the X-ray unit of the present invention is the use of a sealed X-ray generating module which is completely removed and replaced when any component in the moduole fails. As a result, any worker can change the X-ray generating module and the necessity for skilled personnel is eliminated. This reduces the unit's down-time and greatly increases the system's efficacy.

In order to achieve the flexibility and complete remote control provided by the X-ray unit of the present invention, highly sophisticated solid state circuitry was created. The extraordinary level of technology necessary for achieving the desired total remote control was further complicated by new required standards recently imposed by various Federal agencies on X-ray units. Also, the desirability of incorporating into the X-ray unit of the present invention various backup systems which will prevent any potentially hazardous breakdowns, as well as potential hazards due to operator error, added further challenges. In spite of these various obstacles, a highly sophisticated, completely portable X-ray unit was developed, having a hand-holdable remote controller capable of complete control at any remote location over the entire X-ray unit's operation.

Most difficulties encountered with prior art X-ray units are found in the X-ray tube and premature breakdown of the tube. It is believed that many of the X-ray tube breakdowns are attributable to improper control over the total power to which the tube is exposed, as well as employing the tube at levels far above its maximum allowable power.

Consequently, in order to avoid prior art X-ray tube failures as well as develop a system which is capable of extending the typical longevity of an X-ray tube, the portable X-ray unit of the present invention automatically assures that the maximum power rated for the X-ray tube is not exceeded in each operation regardless of the kVp and the time selected by the operator. This is achieved by automatically selecting the maximum mA for the particular time and kVp selected by the operator. In this way, the tube operates at maximum capacity for each exposure, eliminating the widely varying limits to which prior art tubes are exposed as well as completely preventing any situation where potentially too much power is supplied to the X-ray tube.

The other problem encountered in developing the portable X-ray unit of the present invention was to develop a system which is capable of providing the necessary controls in a single, hand-held unit, while also providing the necessary information to the operator to assure complete, accurate, knowledgeable control over the entire X-ray system. The portable X-ray unit of the present invention achieves all of these goals by providing a highly sophisticated system with complete adaptability and portability, and a high degree of accuracy equal to or surpassing the prior art bulky and cumbersome X-ray units.

Using the hand-held remote controller of the present invention, the operator can set the park kilovolt level (kVp), the exposure time, and initiate the operation of the X-ray generator module. Also, the remote controller informs the operator when power to the system is on, when the equipment is ready to deliver the desired power level, and when an X-ray exposure is being made. In this way, full control as well as complete operating information is available to the operator at any remote location.

In one embodiment, the portable X-ray unit of the present invention is capable of maintaining operator selected exposure times ranging between 1/120th of a second and 4 seconds. The kVp level is readily selectable between 60 and 100 kilovolts. As a further feature for providing the operator with full information, the hand-held remote controller incorporates a readout of mAs (milliamps times seconds) which is to be applied to the filament of the X-ray tube for the selected levels.

Any skilled or semi-skilled operator can quickly and easily operate, with maximum efficiency, the X-ray unit of the present invention, using only the hand-held remote controller. To do so, the desired kVp is selected by the operator. Typically, the necessary kVp level is known by the operator for the penetration of tissue desired. Then, the operator selects the desired exposure time in which he knows he will obtain a good picture. In some instances, the operator might use the visually displayed mAs level and the exposure time select switch by changing the exposure time until the particular desired mAs level which the operator knows needs to be employed is obtained.

Employing the operator selected kVp level switch and exposure time switch, the system automatically determines the maximum mA level deliverable to the filament of the X-ray tube in order to maximize the power to the tube within its heat dissipation qualitites. This provides greater longevity to the X-ray tube simultaneous with maximum power utilization.

This maximum deliverable mA level is controlled by varying an RC time constant to a frequency generator. The RC time constant is controlled by the pre-selected kVp level and exposure time. The variable frequency output of the frequency generator of the remote controller is delivered to the main housing for amplification and then delivered to the filament transformer which produces the optimum mA level.

With the X-ray unit of the present invention providing the operator with the complete operating information of the main unit, X-ray exposure of the patient is kept to a minimum. Furthermore, the operator has, in the palm of his hand, all of the necessary information, visually displayed and easily controlled, in order to obtain precise accurate X-ray results with a minimum of effort and retakes.

The invention accordingly comprises the features of constructions, combination of elements, and arrangement of parts which will be exemplified in the construction hereinafter set forth, and the scope of the invention will be indicated in the Claims.

THE DRAWINGS

Reference should be had to the following Detailed Description taken in connection with the accompanying Drawings in which:

FIG. 3 is an exploded perspective view of the main housing and the sealed X-ray generating module and control circuitry housed therein;

FIG. 4 is a cross-sectional top plan view of the sealed X-ray generating module of FIG. 3;

FIG. 5 is a cross-sectional front elevation view of the sealed X-ray generating module of FIG. 3;

DETAILED DESCRIPTION

Figure 1:
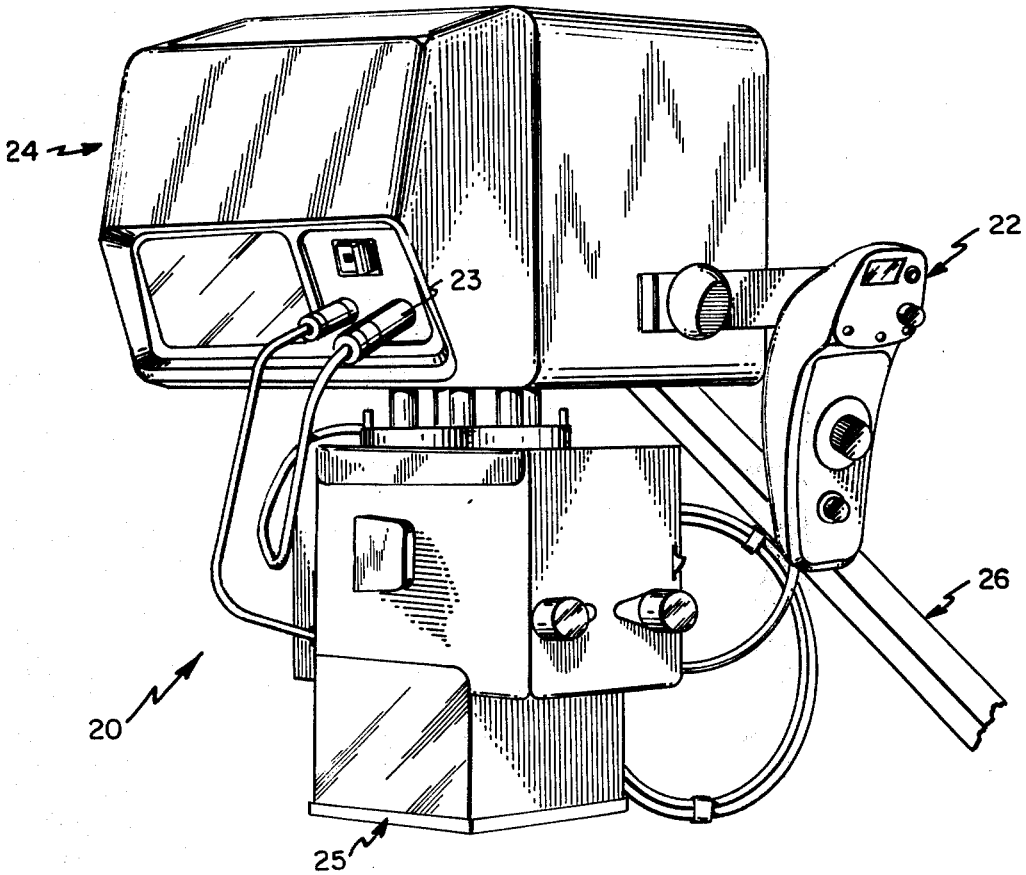
FIG. 1 is a perspective view of the portable X-ray unit of the present invention.

In FIG. 1, one example of a completely assembled portable X-ray unit 20 of the present invention can best be seen. X-ray unit 20 incorporates a remote controller 22, which is easily and comfortably held in the hand of the operator and is controllably connected to main housing 24 by a removable pin connector 23.

X-ray unit 20 is mounted to supporting struts 26 which are connected to a support member (not shown). Preferably, the support member is mounted on wheels in order to assure the complete maneuverability and flexibility of portable X-ray unit 20.

As is more fully described below, main housing 24 encloses control circuitry and an X-ray generating module. Also, X-ray unit 24 incorporates a collimator 25, which is well known in the art, to allow the operator to adjustably control the X-ray exposure area. The collimator is adjusted by moving pivotable lead panels, which reduce the exposure area to the necessary limits. The actual exposure area is visually set using a high intensity lamp which cooperates with the movable panels and provides an accurate simulation of the X-ray exposure path.

Throughout the specification, portable X-ray unit 20 will be fully and completely detailed. However, unit 20 and its associated detailed description should be considered as an example of one unit. It is not intended that unit 20 represent the only embodiment of the present invention since, as will be obvious to one skilled in the art, many variations can be made in the construction or operation of the disclosed X-ray unit without departing from the scope of protection to which the present invention is entitled. Furthermore, aspects of the present invention can be incorporated into presently existing X-ray units, creating a unit which visually appears different but which, in fact, employs protectable concepts of the present invention.

REMOTE CONTROLLER

Figure 2:
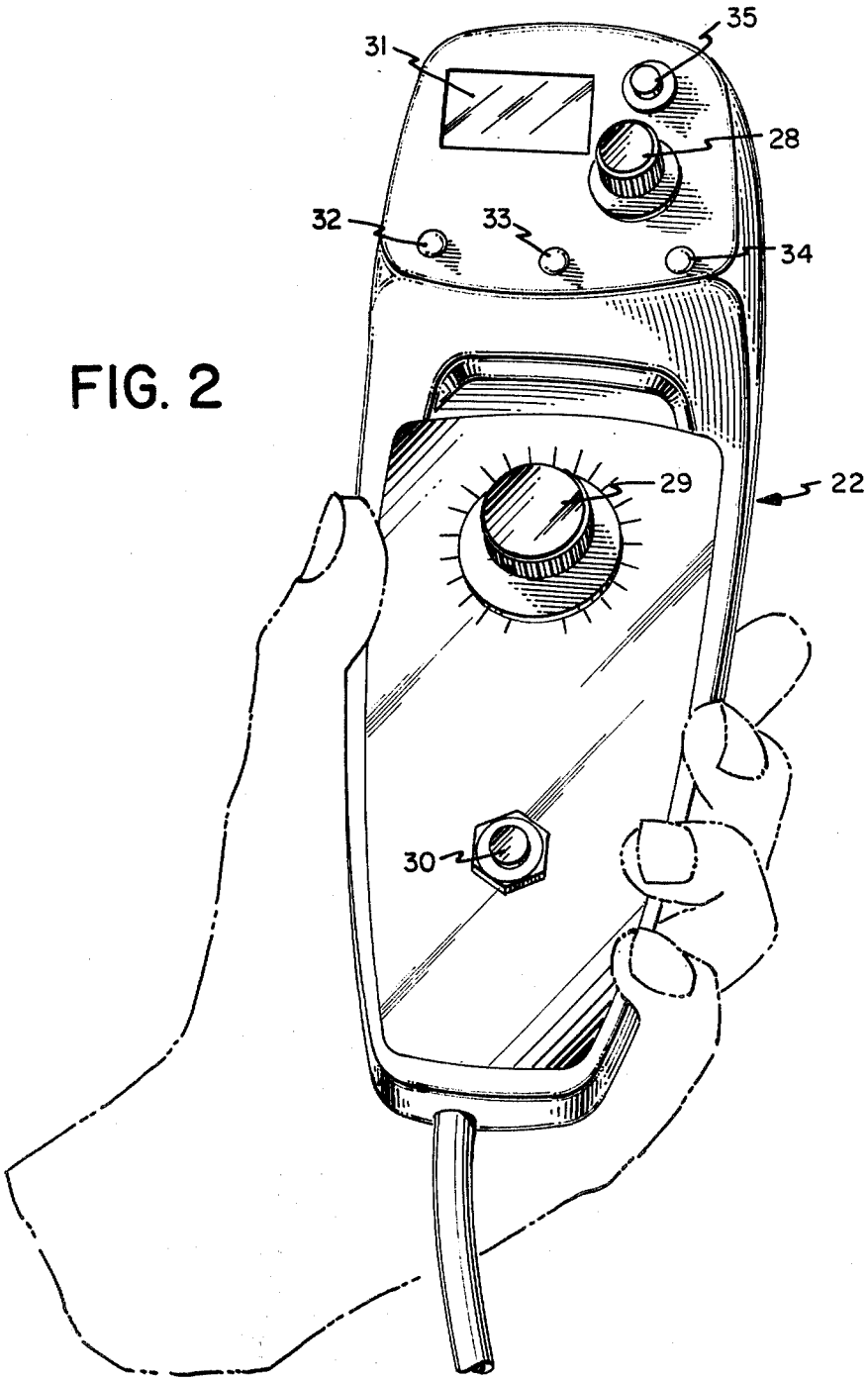
FIG. 2 is a perspective view of the hand-held remote controller of the X-ray unit of the present invention.

One of the major unique aspects of X-ray unit 20 of the present invention is the incorporation of the hand-holdable, remote controller 22, with which the operator is able to completely control all operational functions of the X-ray unit from any desired remote position. As best seen in FIG. 2, remote controller 22 incorporates a peak kilovolt or kVp selection switch 28, an exposure time selection switch 29, an operate button 30, and a milliampere-second, or mAs, display 31. Controller 22 also incorporates illumination means for providing the operator with information concerning the operation of the X-ray unit. These illumination means preferably are LED displays providing a ready light 32, an exposure light 33, and a power-on light 34. Controller 22 also incorporates a reset button 35 for preparing the system for an X-ray exposure.

As can be readily seen, remote controller 22 provides the operator with complete system control and complete operational feed-back information for knowledgeably controlling the entire operation of the X-ray unit. In this way, complete maneuverability and flexibility is provided in an X-ray system in a manner which has heretofore been completely unobtainable.

Furthermore, the operator is capable of preselecting a particular kVp level and a particular exposure time with the exact mAs being visually displayed on LED readout 31. In most prior art systems, the operator is required to mentally compute the mAs in order to assure that a sufficient X-ray level will be obtained to provide the desired result.

Most operators are trained in the level of kVp necessary to achieve a particular X-ray penetration, depending upon whether soft tissue or bone is to be penetrated, and also trained to know the most desirable exposure time for a particular situation. In many instances, however, the operator is also knowledgeable on the particular mAs required to achieve a particular desired result. Consequently, by using the X-ray unit of the present invention, this operator can set the necessary kVp and then adjust the exposure time to a minimum, by merely viewing the mAs display 31 until the particular necessary mAs level is visually displayed. In this way, operator speed is enhanced as well as exposure accuracy, since mental computations by the operator are completely eliminated.

As briefly discussed above, remote controller 22 provides the operator with a hand-held unit which completely controls the entire X-ray unit 20 and provides the operator with all necessary information. When main housing 24 is connected to a power source and turned on, power on light 34 is illuminated, providing the operator with a positive indication that the machine is operational. The operator then sets a particular kVp required for the desired X-ray exposure, with five levels between 60,000 and 100,000 volts being available in this particular example. Then, as discussed above, the operator selects the exposure time, either directly or to correspond with the desired mAs level visually shown on display 31.

Once the various selections have been made, ready light 32 will be illuminated as soon as the milliampere, or mA generating circuitry is ready to maintain and deliver a high mA. As is fully discussed below, X-ray unit 20 in this typical example, maintains a high mA capability for 30 seconds and, if no exposure has been taken, the mA level drops down to a standby level and ready light 32 goes off. If a high mA is desired, when in a standby situation, the operator presses reset button 35 which automatically re-activates the mA circuitry into the high mA level.

When ready light 32 is illuminated, the operator presses operate button 30 in order to activate the X-ray tube. Exposure light 33 is illuminated as soon as power is delivered to the X-ray generating system, and remains illuminated for the pre-selected exposure time, going off as soon as power to the X-ray tube has automatically ceased.

In this example, operator button 30 functions as a "deadman's switch", to enable the operator to immediately stop the unit in an emergency. If an emergency were to occur, the simple release of button 30 will automatically stop the generation of X-rays.

MAIN HOUSING

In addition to collimator 25, main housing 24 incorporates, as shown in FIG. 3, X-ray generating module 38 and power control circuitry 39, both removably housed in container 23. For ease of assembly and disassembly, module 38 is bolted to container 23 on one readily accessible wall thereof, and power control circuitry 39 is conductively connected and physically mounted in place by engaging plug connectors 49 of module 38. The assembly is completed by placing mounting cover 27 in position over control circuitry 39.

The power control circuitry 39 delivers the necessary operating power to remote controller 22, receives information from remote controller 22, and receives and delivers high voltage power along with the desired kVp level to the high voltage transformer (contained in X-ray generating module 38) and the desired mA level to the filament transformer (also housed within container 38). Furthermore, as thoroughly discussed below, power control circuitry 39 incorporates various solid state components to provide the desired rectification and filtering of the incoming power.

X-RAY GENERATING MODULE

As best seen in FIGS. 3, 4, and 5, X-ray generating module 38 comprises a completely sealed unit with all of the components contained therein totally immersed in oil 37 for cooling purposes. Module 38 also incorporates expansion bellows 43, in order to compensate for the expansion and contraction of oil 37 as it changes temperature during its performance as a heat sink.

Housed within X-ray generating module 38 is an X-ray tube 40, a high voltage transformer 41, and a filament transformer 42. Preferably, X-ray tube 40 is a small, low power tube which is employed, as detailed below, to its maximum power capabilities. In this example, tube 40 is a type 01X-P manufactured by Eureka. Transformer 41 is a typical high voltage transformer incorporating windings 44 and core material 45.

Preferably, X-ray tube 40 is positioned between windings 44 of transformer 41 in the plane which extends equidistantly between windings 44. This plane also defines the plane in which the induced magnetic fields around windings 44 have maximum interaction. As shown in FIG. 4, tube 40 with its peripherally surrounding lead alloyed ceramic shield 46, is positioned, as close as practical, to windings 44.

The position of X-ray tube 40 is important for several different reasons. One result achieved by this position is a substantial reduction of X-ray leakage without requiring heavy lead shielding panels. Windings 44 effectively shield the X-ray tube and substantially eliminate unwanted X-ray leakage. This "built-in" shielding enables X-ray generating module 38 of this invention to achieve a low X-ray leakage level while also being lightweight in comparison to prior art systems.

Another advantage that has been found to exist from the location of X-ray tube 40 is a pre-focusing of the electron beam coming from the filament and striking the target to produce the X-rays. Although the X-ray tube 40 employed in this example is rated as having an electron beam that is 1 millimeter square at 5 mA, tests have shown that the actual electron beam produced by tube 40 as part of generating module 38 is less than 1 millimeter square at much higher mA levels. This result is extremely advantageous since a concentration of the electrons increased the resolution of the resulting picture.

Pre-focusing results from positioning X-ray tube 40 between windings 44 of high voltage transformer 41. In this way, the magnetic field around windings 44 have a constructive collimating effect on the electron beam, producing a compact, pre-focused beam.

In typical X-ray operations, the size of the electron beam increases as the mA level increases. Consequently, the attainment of a more concentrated electron beam at higher mA levels than the tube rating is an important achievement. In particular, tube 40 is rated to have a beam of $1.2\times1.4$ mm. at 5 mA. When this tube was tested in module 38, a beam substantially smaller than $1.0\times1.0$ mm was obtained at the very high level of 30 mA. Consequently, it is concluded that the position of tube 40 between windings 44 in module 38 produces a pre-focusing of the beam and achieves and maintains a small focal spot, even at increasing filament current levels.

A further major advantage of X-ray generating module 38 is its complete replaceability upon failure. In this way, a faulty system is quickly and easily repaired by unskilled personnel. In prior art systems any tube replacement is an extremely time consuming project, requiring skilled technicians to perform the task. Using the system of the present invention, module 38 is easily replaced by removing cover 27, unplugging circuit board 39, unbolting module 38 from main housing 23, and then inserting a completely new module. In this way, down-time of the X-ray unit is held to an absolute minimum.

The internal construction of module 38 is shown in FIGS. 4 and 5. Referring first to FIG. 4, X-ray tube 40 is shown peripherally surrounded by ceramic shield 46. Ceramic shield 46 incorporates a lead alloy which prevents the X-rays generated from tube 40 to escape in all directions from tube 40. Instead, shield 46 incorporates a single window 47 which is positioned in juxtaposed spaced relationship to the target within X-ray tube 40, thereby allowing the X-rays to escape in the desired path. Since ceramic shield 46 incorporates lead material in its composition, a lightweight but effective shield member is obtained.

In FIG. 5, X-ray tube 40 is shown with ceramic shield 46 removed. In this way, the actual X-ray generating elements of tube 40 can be seen. In particular, X-ray tube 40 incorporates a filament 47' which acts as the cathode of X-ray tube 40 with a target formed in the anode 48 of X-ray tube 40. As is well known in the art, high voltage from high voltage transformer 41 is applied between the anode 48, with the target embedded therein, and cathode 47' while current is directly applied to filament 47' from filament transformer 42 for purposes of generating free electrons by thermionic emission. In this way, free electrons are generated at filament 47' and due to the high voltage potential, bombard the target, producing the desired X-rays. In this example, the target material comprises tungsten, however, any other suitable target material can be employed.

Due to the extremely high voltage present in conjunction with the milliampere electron beam current flow, very high energy electrons strike the anode target 48. These high energy electrons upon impact with the target not only generate the desired X-rays but also generate a great deal of heat. The amount of heat energy is a function of the electron beam power (kVp times mA) times the length of time that the beam exists. In this example, this time ranges from 1/120th of a second to 4 seconds. This heat is dissipated from the anode by a heat sink within X-ray tube 40. The heat sink is preferably made of copper, which due to its high heat conductivity, prolongs the life of X-ray tube 40 by minimizing the temperature rise at the anode target. In addition, heat is generated by the filament 47' as well as within the high voltage transformer 41 and filament transformer 42.

All this generated heat must therefore be dissipated by the anode target 48 into sealed container 38. Consequently, as mentioned above, all of the components housed within container 38 are completely immersed in a high grade oil, which serves the purpose of absorbing the heat generated and also as a high voltage insulator.

OVERALL SYSTEM OPERATION

Figure 6:
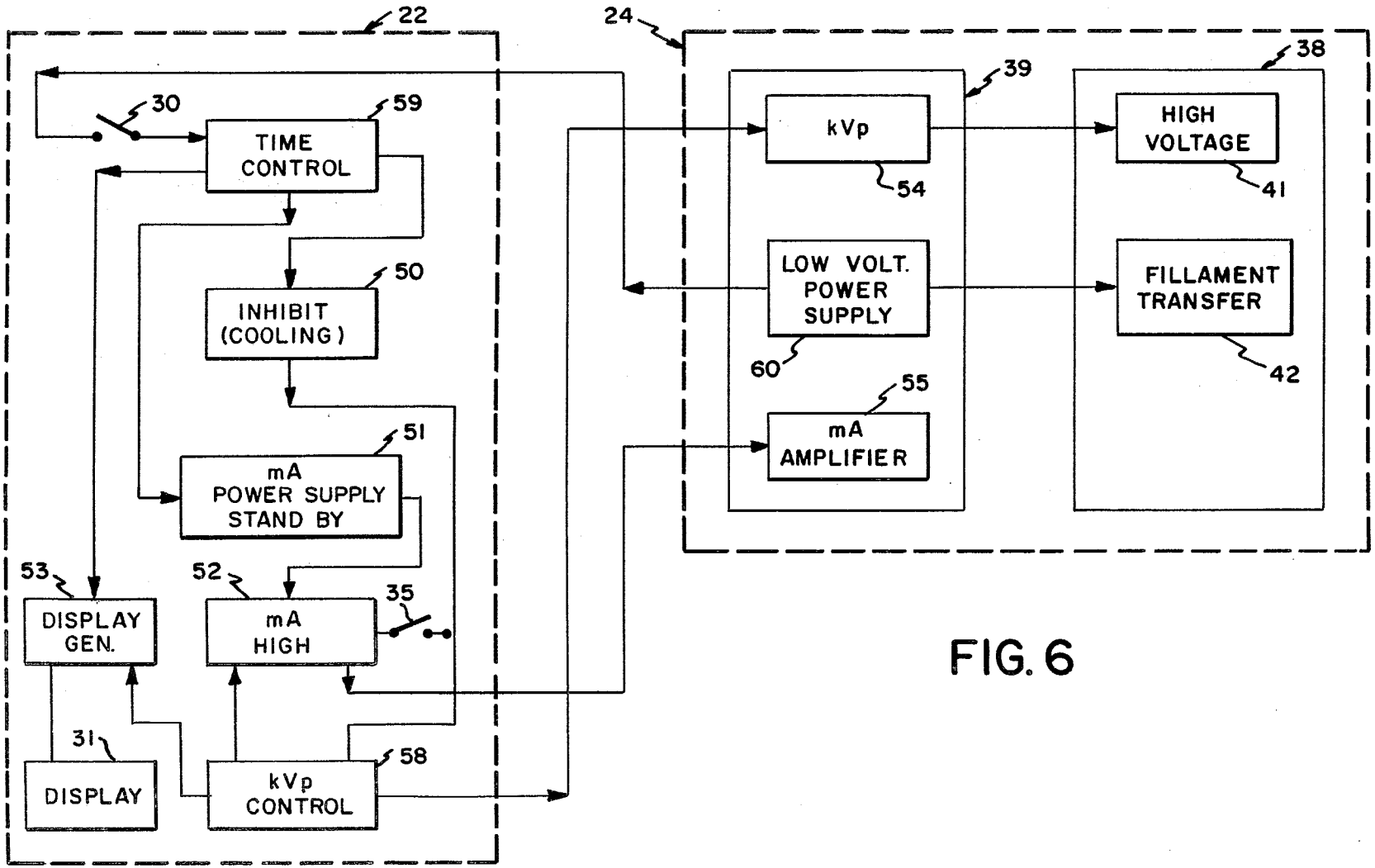
FIG. 6 is a schematic representation of the overall electronic circuitry of the X-ray unit of the present invention.

In FIG. 6, the functional operation of the circuitry of the X-ray unit of the present invention is shown with the circuitry housed in the remote controller and in the main unit detailed therein. As discussed above, and as seen in FIG. 6, remote controller 22 incorporates the operating button 30, exposure time select switch 29, reset button 35, kVp select switch 28 and mAs display 31. However, in order to provide remote controller 22 with the capability of providing complete operational control to the X-ray unit itself, remote controller 22 also incorporates mA inhibit circuitry 50, mA power supply standby circuitry 51, mA high level control circuitry 52, and display generator circuitry 53.

As previously discussed, main unit 24 incorporates X-ray generating module 38 and power control circuitry 39. As detailed above, X-ray generating module 38 incorporates high voltage transformer 41 and filament transformer 42, both of which are connected to the X-ray tube itself. Power control circuitry 39 incorporates three major operating circuits. The first is kVp switching circuit 54, the second is an mA amplification circuit 55, and the last is a low voltage delivery circuit 60.

By referring to FIG. 6, the general, operational interaction of the circuitry of the present invention can best be understood. As previously discussed, the operator pre-selects the kVp level using the kVp switch which forms a part of kVp control circuit 58 and similarly pre-selects the exposure time using the exposure time control switch which forms a part of time control circuit 59. At the desired time, operate switch 30 is closed.

When operate switch 30 is closed, rectified power from low voltage delivery circuit 60 is supplied to timer control circuit 59. In order to assure the proper operation and increased longevity of the X-ray tube without any damage, and without requiring operator activation, automatic cooling of the X-ray tube is incorporated into the circuitry of the present invention by using inhibit circuit 50 of remote controller 22. Inhibit circuit 50 assures that after the X-ray tube has been used, a pre-established, fixed cooling period is required before the tube can be reused.

Also, the proper operation of the X-ray tube requires that sufficient current be available for maintaining the filament at the desired mA level for the entire exposure time. Consequently, mA power standby circuit 51 and mA high level circuit 52 are employed to assure the proper level of current is present and is delivered for the duration of the X-ray exposure.

As is fully detailed below, mA high level circuit 52 maintains a high mA level for a fixed time period, and then automatically goes into a standby mode, unless an exposure is in progress. If the mA level is in standby and X-ray activation is desired, reset button 35 must be closed. This actuates high mA circuit 52 to provide a high mA level after a short, fixed warm-up time period has elapsed.

One output signal from time control circuit 59 is fed to inhibit circuit 50, in order to assure that the X-ray tube has been cooled to the desired extent before delivering the output signal to kVp control circuit 58. Another output signal of time control circuit 59 is connected to mA power supply standby 51 which is in turn connected to mA high level circuit 52. These signals, in combination with the output signal of kVp control circuit 58, which is also delivered to mA high level circuit 52, assure that the maximum mA is delivered during the desired selected time exposure.

The output signal from mA high circuit 52 is fed to mA amplifier 55 of power control circuit 39. Similarly, when all of the conditions have been met, kVp control circuit 58 feeds its output signal to kVp switching circuit 54 of power control circuit 39.

One of the unique aspects of the X-ray unit of the present invention is the use of a variable frequency to control the desired mA level. The mA high level circuit 52 receives both the kVp selection and the exposure time selection. These two signals establish a particular RC time constant in a frequency generator incorporated in circuit 52. Consequently, for each selection made by the operator, a different frequency output is produced as an output signal. This frequency output is amplified in mA amplifier 55 and delivered to filament transformer 42 for developing and delivering the optimum mA to the filament of the X-ray tube for the conditions selected.

The mA level automatically established by the system employs both the kVp level and exposure time selected by the operator to achieve an mA level which will maximize the energy (power times time) input to the X-ray tube, within its capabilities. In this way, a small X-ray tube is effectively used at its maximum power levels without decreasing the tube life.

High voltage transformer 41 is controlled by kVp switching circuit 54 which assures that the desired windings of high voltage transformer 41 will be energized in order to produce the desired kVp level selected by the operator. However, both the kVp and the mA input signals received by power supply circuit 39 are controlled by timer circuit 59, to assure initiation and termination at the precisely requested exposure time.

Also, both time control circuit 59 and kVp circuit 58 have outputs which are connected to the display generator 53. Display generator 53 receives the particular information, determines the maximum mA and energizes display 31 to show the particular mAs for the settings being employed.

For a further, more detailed discussion of the construction of the control circuitry of this example and its arrangement for providing the desired functions discussed above, reference should be had to FIGS. 7, 8 and 9, in which the entire circuitry for this example of the X-ray unit of the present invention is specifically detailed.

REMOTE CONTROLLER CIRCUITRY

Figures 7A, 7B:
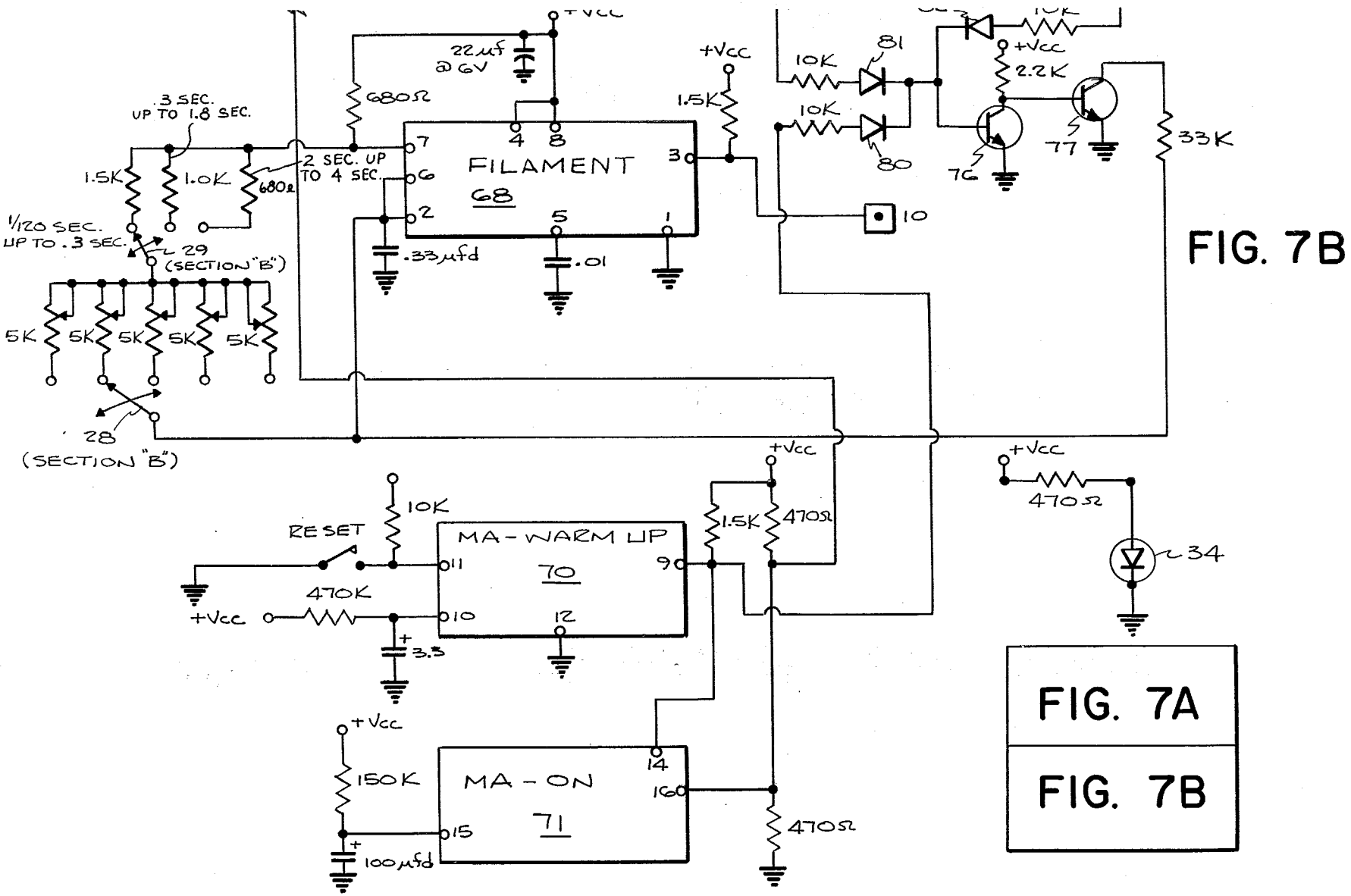
FIG. 7 is a schematic view showing the detailed electronic circuitry housed in the remote controller.
Figure 7A:
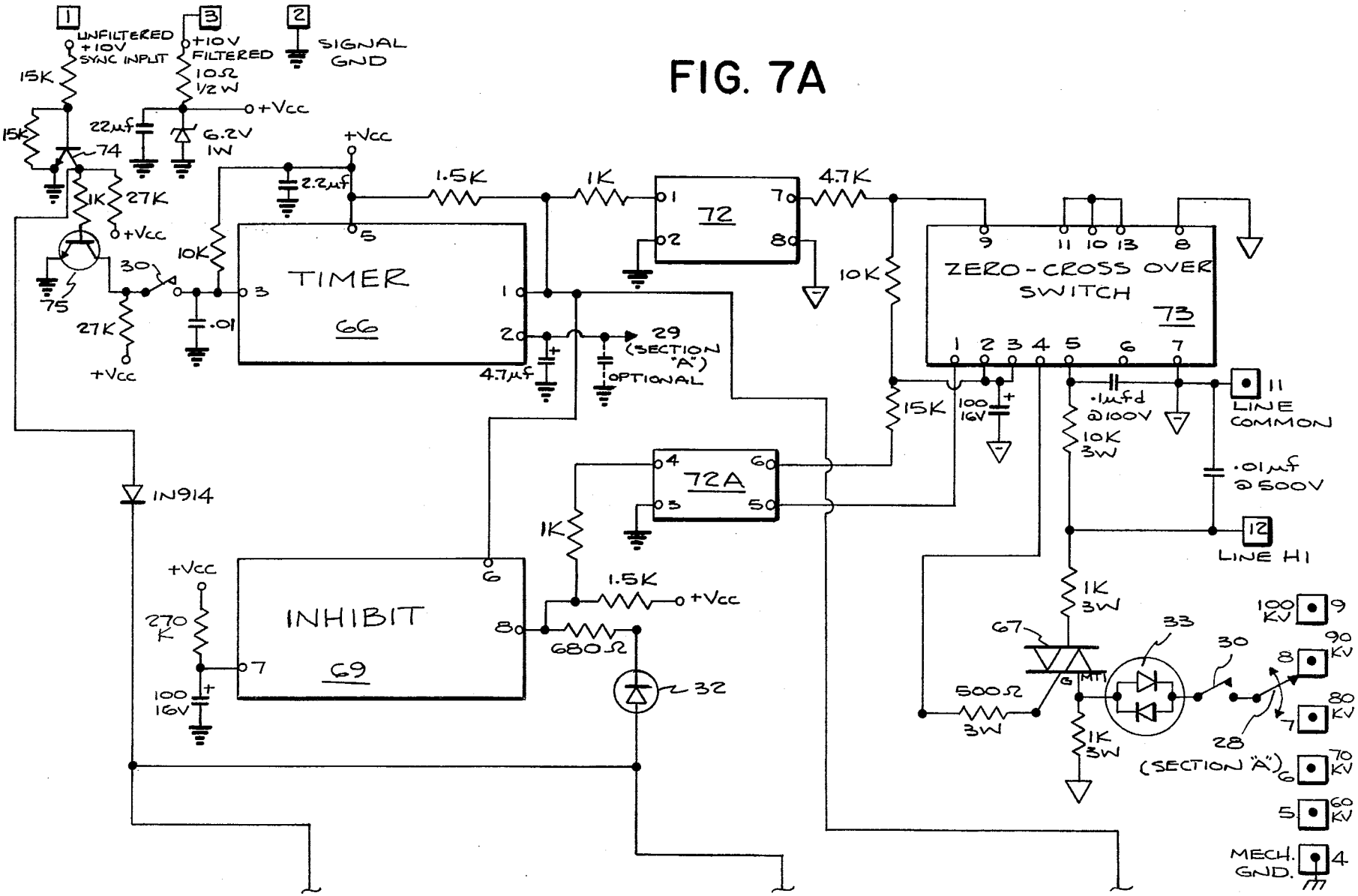
Figure 8:
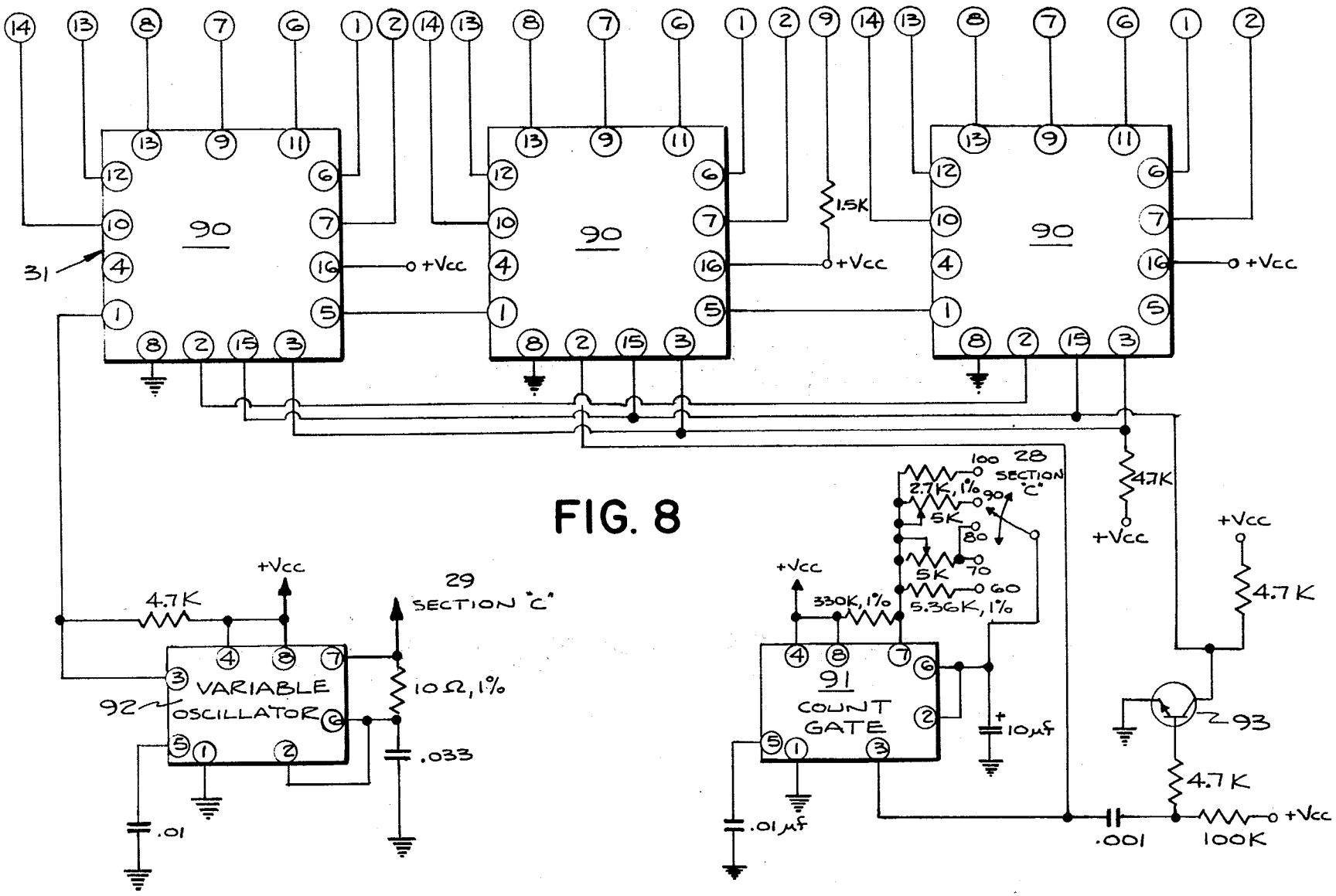
FIG. 8 is a schematic view of the detailed electrical circuitry of the display of the remote controller.

In FIG. 7, the circuitry of the remote controller 22 for this example of an X-ray unit of the present invention is shown in detail. In addition to the circuitry of FIG. 7, remote controller 22 incorporates the circuitry shown in FIG. 8 which represents the mAs display.

In order to provide a hand-holdable controller capable of completing operating the entire X-ray unit from a remote position, various multilevel switches are employed to provide a plurality of different circuit connections from a single external switch. The circuit representation of this arrangement can be seen in FIG. 7, wherein operate switch 30 is shown as a two level switch connecting LED exposure lamp 33 to the kVp level selected by switch 38, and also interconnecting the power input from pin 1 of connector 23 to timer chip 66.

In the preferred embodiment of this example, operate switch 30 is designed to close between LED 33 and switch 28 before providing power to the unit. In this way, potentially hazardous sparking is prevented since no power exists at LED 33 when the first level of switch 30 is closed. Also, this construction allows switch 30 to operate as a "deadman's" switch by interrupting the signal to kVp select switch 28 whenever the operator releases switch 30.

The kVp select switch 28 is also a multileveled switch with one level, identified as Section "A", being used to connect the output power from triac 67 to the particular pin connections corresponding to the desired kVp level. Another section of kVp switch 28, identified as Section "B", is used as an input to filament current control chip 68.

Figure 11:
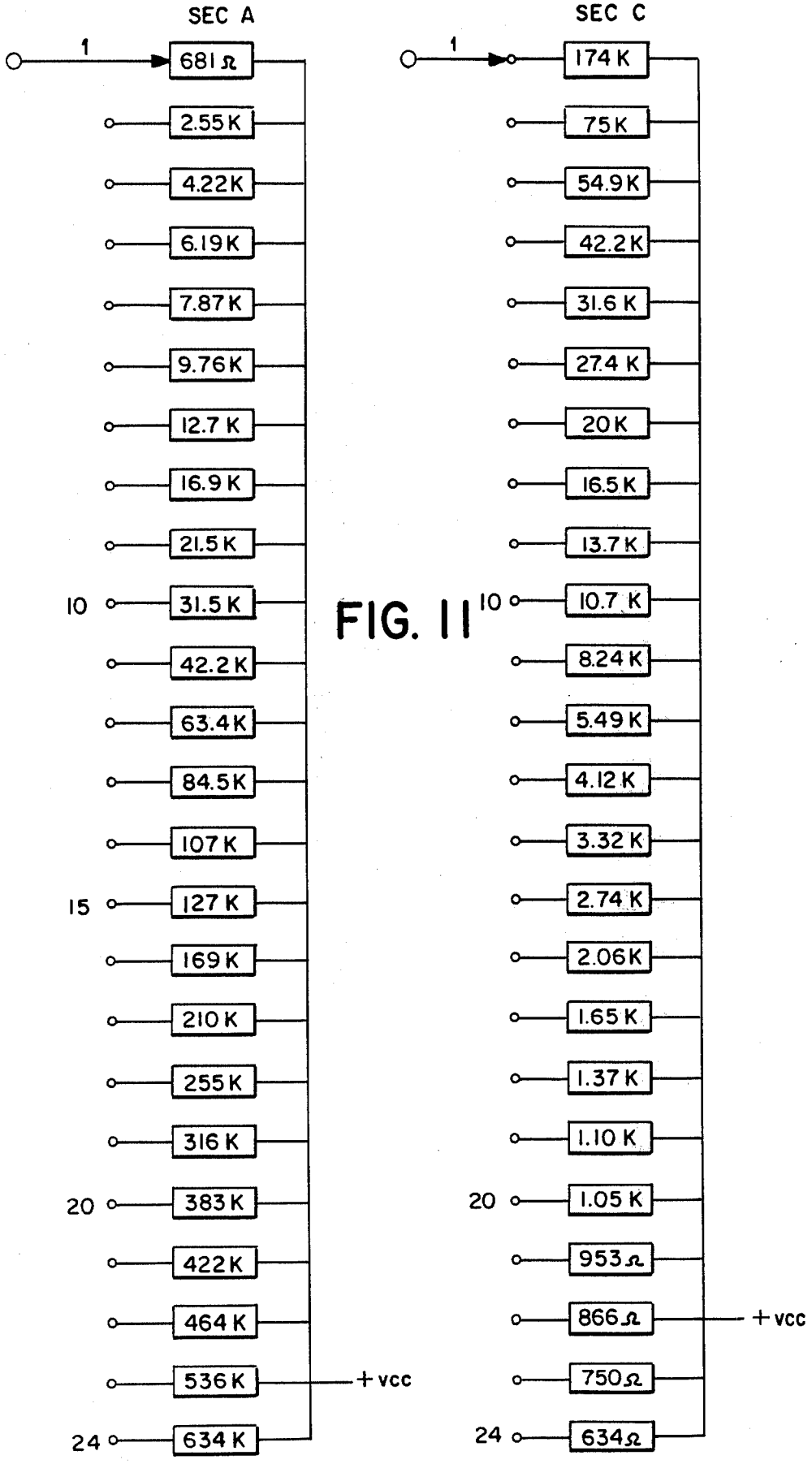
FIG. 11 is a schematic representation of two levels of the exposure time control switch of the remote controller.

Finally, exposure time select switch 29 is multileveled with one level, identified as Section "A", connected to pin 2 of timer chip 66, and a second level, identified as Section "B", connected in series with Section "B" of kVp switch 28 to form the frequency controlling input to filament chip 68. Both kVp switch 28 and exposure time select switch 29 have a third level, identified as Section "C" in each, which is connected to the mAs display circuitry shown in FIG. 8 and detailed below. The actual construction of both Sections "A" and "C" of exposure time select switch 29 is shown in FIG. 11.

Before discussing the operation of the remote controller circuitry, the major components contained within the circuitry is discussed along with the major function of each component. One such component is inhibit chip 69 which is incorporated in order to impose a fixed time delay into the operation of the system before a second exposure can be initiated by the operator. In this way, the operator is not required to be cognizant of the cooling characteristics of the X-ray tube since inhibit chip 69 provides an automatic fixed time delay, consistent with the tube's characteristics, to allow the X-ray tube to cool.

The circuitry also incorporates an mA warmup chip 70 and an mA ON chip 71 which assure that the proper level of current is ready and that the filament is operational, before the X-ray tube is fully activated. Since the filament might rapidly evaporate if a high mA level was continuously delivered to it, the mA ON chip 71 provides a high mA level for a fixed time period and then drops into a standby mode, unless an X-ray exposure is in progress. If an X-ray exposure is being taken, the mA level remains high until the exposure time is completed. If the mA level is in the standby mode and a high mA is desired, reset button 35 is closed, turning on mA warmup chip 70 to provide, after a short fixed time delay, another fixed period of high mA.

In order to segregate low voltage signals which are transmitted to the high voltage circuitry, optical couplers 72 and 72A are employed. In this way, line isolation is achieved and eliminated. Finally, the circuit incorporates a zero crossover switch chip 73 which is employed to insure that the signals sent to triac 67 are controlled and regulated to be transmitted precisely at the crossover points of the alternating input current.

In the preferred embodiment, timer chip 66, inhibit chip 69, mA warmup chip 70 and mA ON chip 71 all comprise a single "quad chip" manufactured by Signetics, Inc., which is commonly known as a 558 chip. Filament chip 68 operates as a free running multivibrator and in the preferred embodiment comprises Signetics, Inc.'s 555 chip. Optical couplers 72 and 72A are preferably Monsanto optical couplers and zero crossover chip 73 comprises RCA No. CA3059.

In addition to these components, the circuit incorporates transistors 74, 75, 76 and 77, all of which comprise, in the preferred embodiment, a single RCA CA 3046. Also, in this example, triac 67 is an RCA T2300, and all of the diodes in FIG. 7 are IN914. The remaining circuit components are identified directly in FIG. 7.

Operation of Remote Controller

By referring to FIG. 7, the operation controlling functions which are performed by the remote controller can best be understood. First, as discussed above, the operator selects the particular kVp level desired by setting switch 28 and the particular exposure time desired by rotating switch 29.

Of course, the main power switch on the main unit would be turned on, and this would be apparent to the operator from the illumination of LED 34 of remote controller 22. The main generating power for remote controller 22 is delivered to pin 3 of connector 23 as a rectified, filtered, pulse.

The output signal from pin 16 of mA on chip 71 is transmitted to LED 32 and inhibit chip 69, if the inhibit chip is not cycling in its fixed time delay period. If the inhibit chip 69 is off, ready LED light 32 will be illuminated and the operator will be informed that the system is set for operation.

Once the ready LED 32 is on, the operator is informed that operate button 32 can be closed. Upon closure of switch 30, the incoming oscillating DC current is transmitted from transistor 74 through transistor 75 to provide a shaped synchronized DC input pulse to timer chip 66. Upon initiation from operate button 30, timer chip 66 generates an output signal depending upon the exposure time interval set by the operator on switch 29. In this case, it is Section "A" of switch 29 which controls the timer output.

The output signal from pin 1 of timer chip 66 is transmitted through optical coupler 72 to the zero crossover switch 73. Simultaneously, this output signal is transmitted to diode 82 to turn on transistors 76 and 77 and allow the incoming exposure time controlled signal to be delivered to filament chip 68 so as to lock filament frequency while exposure is taken.

Zero crossover switch chip 73 receives the incoming timer signal from optical coupler 72 and provides an output signal to triac 67 which is perfectly synchronized with the zero point of the incoming AC power. In this way, precise control is maintained over the signal delivered to triac 67 with the capability of providing an on and off signal within one-half cycle of the sixty cycle input. Consequently, exposure times of 1/120th of a second are efficiently and accurately obtained.

Triac 67 serves as a driver for high powered triacs which are connected to the primary of the high voltage transformer to generate the 60,000 to 100,000 volts for delivery to the X-ray tube. These high powered triacs are contained within the main housing and will be discussed in reference to FIG. 9.

By employing zero crossover switch 73, there is positive assurance that the triacs in the main housing will only be activated at the zero crossover points of the AC power input. This is extremely important in dealing with the high voltages handled by the triacs, since any other situation may result in activating the triacs at a high voltage which could potentially destroy the transformer and the X-ray tube.

Although zero crossover switches have been employed in this type of situation to control high voltage applications, prior art systems have never achieved such switching at remote locations using solid state devices. Along with more reliability and greater flexibility, exposure times of 1/120th of a second are achieved. Such reliability and performance characteristics have been completely unobtainable in prior art systems.

As shown in FIG. 7, Section "A" of kVp select switch 28 determines which high voltage winding receives the activating signal and consequently which triac is activated in the main unit. The output from triac 67 also activates LED 33 in order to provide the operator with a visual display of the actual exposure duration. As discussed above, switch 30 has two levels, and the level connecting LED 33 to kVp switch 28 is closed first in order to prevent any possible arcing.

Of particular interest, LED 33 is a bidirectional LED and is employed in order to provide a display light which will be visible at the rapid exposure times of as small as 1/120th of a second.

Inhibit chip 69 provides a built-in time delay in order to assure that after the X-ray tube has been employed, a fixed time period must elapse before the X-ray tube can be used again. In this example, a delay period of 60 seconds is employed. This allows sufficient time for the X-ray tube to cool off, without requiring the operator to worry about the particular cooling characteristics of the tube, as conventional prior art units so require. In this way, operational simplicity as well as built-in protection for preventing overheating is obtained.

Inhibit chip 69 also provides an added backup for assuring termination of the activating signal at the desired exposure time. This is achieved by transmitting the inhibit signal from pin 8 to optical coupler 72A which is connected to zero crossover switch chip 73. Consequently, when inhibit chip 69 is fired, due to the termination of the activation signal, the inhibit on signal is automatically fed into crossover switch 72A to assure the termination of the output signal from zero crossover switch 73. In normal operation, zero crossover switch 73 should shut off at the desired exposure time, however, inhibit chip 69 through optical coupler 72A provides an added backup to assure this result.

Section B of kVp select switch 28 and timer select switch 29 both physically incorporate particular resistors for each setting, with these two levels of the switches being connected in series. In this way, a particular RC time constant is established for controlling the frequency input into filament chip 68 which will provide the desired maximum mA output deliverable to the filament transformer. The output of filament chip 68 is supplied directly to the power amplifier located in the main unit by delivering this controlled variable frequency signal to pin 10.

An important feature of the X-ray unit of the present invention is the use of the operator selected kVp level and exposure time to automatically set the particular mA level to deliver maximum power to the X-ray tube for the particular conditions selected. Of course, the tube characteristics and heat dissipation capabilities are employed in determining the maximum mA level for particular conditions. In this way, a small, lightweight X-ray tube is employed and obtains output capabilities previously obtainable only with larger X-ray tube systems.

The mA level automatically selected by the system for the particular operator controlled conditions is designed to impose a substantially constant energy level (power per unit time) on the X-ray tube. By maintaining the X-ray tube at substantially constant energy levels regardless of the variety of operator selected conditions, the X-ray tube life is increased. It is believed that the use of X-ray tube at a wide variety of conditions imposes undesirable stresses on the X-ray tube, causing early degradation of the tube. Consequently, the substantially constant conditions to which the X-ray tube is exposed in the unit of the present invention is believed to provide added tube life.

By employing the construction of the X-ray unit of the present invention, a small, lightweight X-ray tube is employed and consistently operates at or near its maximum capabilities while not experiencing a shortened tube life. In some types of synergistic interaction, (1) the maintenance of a small focal spot at increasing current levels by positioning the X-ray tube in the magnetic fields of the high voltage transformer windings, (2) the maintenance of maximum energy input to the X-ray tube for all selected conditions by selectively controlling the mA level, (3) assuring automatic cooling of the tube by an exposure inhibit, and (4) providing maximum deliverable power to the filament when required, all contribute either selectively or in combination to provide the synergistic cooperative effect which achieves the otherwise unexpected and unanticipated results.

As discussed above, the filament transformer is controlled by varying the frequency input to the transformer along the slope of one side of the transformer's response curve, to obtain the specifically desired mA level at the filament of of the X-ray tube. A typical mA level delivered to the filament of the X-ray tube of this example is shown in Table I.

In Table I, the peak mA levels automatically determined by the circuitry are shown for each of the various combinations of exposure time and kVp levels which are selectable in this example of the X-ray unit of this invention. Along with the peak mA level, the peak mAs level is also shown as well as the peak dissipation.

In Table II, the various mA levels shown for the various combinations of operator selectable conditions are the average or root mean square mA levels. Also, the associated mAs level which would be incurred in each of the conditions is similarly shown. Other than the use of average mA levels, Table II represents levels obtained when the 680 ohm resistor in Section B of exposure time select switch 29 is not employed. The elimination of the resistor is optional, depending upon customer requirements.

By employing either Table I or II, or any other similar table for a customer designed system, an operator is able to quickly and easily determine the actual mA level as well as the peak mA level which will be provided automatically to the filament of the X-ray tube. Consequently, if a particular level is necessary for the operation to employ, a quick reference to these Tables will enable him to know the exact conditions he must select in order to obtain the desired mA level, as well as the desired mAs level of which he may also be aware.

TABLE I

| Time Sec. | 100 kVp mA Peak | 100 kVp mAs Calc. | 100 kVp Peak Disp. | 90 kVp mA Peak | 90 kVp mAs Calc. | 90 kVp Peak Disp. | 80 & 70 kVp mA Peak | 80 & 70 kVp mAs Calc. | 80 & 70 kVp Peak Disp. | 60 kVp mA Peak | 60 kVp mAs Calc. | 60 kVp Peak Disp. |
|---|---|---|---|---|---|---|---|---|---|---|---|---|
| 1/120 | 28 | .23 | .2 | 33 | .28 | .3 | 38 | .32 | .3 | 47 | .39 | .4 |
| 1/60 | ↓ | .47 | .5 | ↓ | .55 | .6 | ↓ | .63 | .6 | ↓ | .78 | .8 |
| 1/40 | ↓ | 0.7 | 0.7 | ↓ | .83 | .8 | ↓ | .95 | 1.0 | ↓ | 1.18 | 1.2 |
| 1/30 | ↓ | .93 | .9 | ↓ | 1.1 | 1.0 | ↓ | 1.27 | 1.3 | ↓ | 1.57 | 1.6 |
| 1/24 | ↓ | 1.16 | 1.2 | ↓ | 1.38 | 1.4 | ↓ | 1.58 | 1.6 | ↓ | 1.96 | 2.0 |
| 1/20 | ↓ | 1.4 | 1.4 | ↓ | 1.65 | 1.7 | ↓ | 1.9 | 1.9 | ↓ | 2.35 | 2.4 |
| 1/15 | ↓ | 1.87 | 1.9 | ↓ | 2.2 | 2.2 | ↓ | 2.53 | 2.5 | ↓ | 3.13 | 3.1 |
| .08 | ↓ | 2.24 | 2.3 | ↓ | 2.64 | 2.6 | ↓ | 3.04 | 3.0 | ↓ | 3.76 | 3.8 |
| .1 | ↓ | 2.8 | 2.8 | ↓ | 3.3 | 3.3 | ↓ | 3.8 | 3.8 | ↓ | 4.7 | 4.7 |
| .15 | ↓ | 3.45 | 3.5 | ↓ | 3.9 | 3.9 | ↓ | 4.65 | 4.7 | ↓ | 5.55 | 5.6 |
| .2 | ↓ | 4.6 | 4.6 | ↓ | 5.2 | 5.2 | ↓ | 6.2 | 6.2 | ↓ | 7.4 | 7.4 |
| .3 | ↓ | 6.9 | 6.9 | ↓ | 7.8 | 7.8 | ↓ | 9.3 | 9.3 | ↓ | 11.1 | 11.1 |
| .4 | 23 | 9.2 | 9.2 | 26 | 10.4 | 10.4 | 31 | 12.4 | 12.4 | 37 | 14.8 | 14.8 |
| .5 | ↓ | 11.5 | 11.5 | ↓ | 13.0 | 13.0 | ↓ | 15.5 | 15.5 | ↓ | 16.5 | 16.5 |
| .6 | ↓ | 13.8 | 13.8 | ↓ | 15.6 | 15.6 | ↓ | 18.6 | 18.6 | ↓ | 22.2 | 22.2 |
| .8 | ↓ | 18.4 | 18.4 | ↓ | 20.8 | 20.8 | ↓ | 24.8 | 24.8 | ↓ | 29.6 | 29.6 |
| 1.0 | ↓ | 23.0 | 23.0 | ↓ | 26.0 | 26.0 | ↓ | 31.0 | 31.0 | ↓ | 37.0 | 37.0 |
| 1.2 | ↓ | 27.6 | 27.6 | ↓ | 31.2 | 31.2 | ↓ | 37.2 | 37.2 | ↓ | 44.4 | 44.4 |
| 1.5 | ↓ | 34.5 | 34.5 | ↓ | 39.0 | 39.0 | ↓ | 46.5 | 46.5 | ↓ | 55.5 | 55.5 |
| 1.8 | ↓ | 36.0 | 36.0 | ↓ | 41.4 | 41.4 | ↓ | 48.6 | 48.6 | ↓ | 59.4 | 59.4 |
| 2.0 | 20 | 40.0 | 40.0 | 23 | 46.0 | 46.0 | 27 | 54.0 | 54.0 | 33 | 66.0 | 66.0 |
| 2.2 | ↓ | 44.0 | 44.0 | ↓ | 50.6 | 50.6 | ↓ | 59.4 | 59.4 | ↓ | 72.6 | 72.6 |
| 2.5 | ↓ | 50.0 | 50.0 | ↓ | 57.5 | 57.5 | ↓ | 67.5 | 67.5 | ↓ | 82.5 | 82.5 |
| 3.0 | ↓ | 60.0 | 60.0 | ↓ | 69.0 | 69.0 | ↓ | 81.0 | 81.0 | ↓ | 99.0 | 99.0 |

TABLE II

| Time | 100 kVp mA | 100 kVp mAs | 90 kVp mA | 90 kVp mAs | 80 & 70 kVp mA | 80 & 70 kVp mAs | 60 kVp mA | 60 kVp mAs |
|---|---|---|---|---|---|---|---|---|
| 1/120 | 20 | .2 | 27 | .2 | 30 | .3 | 40 | .3 |
| 1/60 | ↓ | .3 | ↓ | .4 | ↓ | .5 | ↓ | .7 |
| 1/30 | ↓ | .7 | ↓ | .9 | ↓ | 1.0 | ↓ | 1.3 |
| 1/20 | ↓ | 1.0 | ↓ | 1.4 | ↓ | 1.5 | ↓ | 2.0 |
| .08 | ↓ | 1.6 | ↓ | 2.2 | ↓ | 2.4 | ↓ | 3.2 |
| .1 | ↓ | 2.0 | ↓ | 2.7 | ↓ | 3.0 | ↓ | 4.0 |
| .15 | ↓ | 3.0 | ↓ | 4.0 | ↓ | 4.5 | ↓ | 6.0 |
| .2 | ↓ | 4.0 | ↓ | 5.4 | ↓ | 6.0 | ↓ | 8.0 |
| .3 | ↓ | 6.0 | ↓ | 8.1 | ↓ | 9.0 | ↓ | 12.0 |
| .4 | ↓ | 8.0 | ↓ | 10.8 | ↓ | 12.0 | ↓ | 16.0 |
| .5 | ↓ | 8.5 | ↓ | 11.5 | ↓ | 12.8 | ↓ | 17.0 |
| .6 | 15 | 9.0 | 20 | 12.2 | 23 | 13.5 | 30 | 18.0 |
| .8 | ↓ | 12.0 | ↓ | 16.2 | ↓ | 18.0 | ↓ | 24.0 |
| 1.0 | ↓ | 15.0 | ↓ | 20.3 | ↓ | 22.5 | ↓ | 30.0 |
| 1.2 | ↓ | 18.0 | ↓ | 24.3 | ↓ | 27.0 | ↓ | 36.0 |
| 1.5 | ↓ | 22.5 | ↓ | 30.4 | ↓ | 33.8 | ↓ | 45.0 |
| 1.8 | ↓ | 26.0 | ↓ | 36.5 | ↓ | 40.5 | ↓ | 54.0 |
| 2.0 | ↓ | 30.0 | ↓ | 40.5 | ↓ | 45.0 | ↓ | 60.0 |
| 2.2 | ↓ | 33.0 | ↓ | 44.6 | ↓ | 49.5 | ↓ | 66.0 |
| 2.5 | ↓ | 37.5 | ↓ | 50.6 | ↓ | 56.3 | ↓ | 75.0 |
| 3.0 | ↓ | 45.0 | ↓ | 60.8 | ↓ | 67.5 | ↓ | 90.0 |

mAs Display

Remote controller 22 incorporates a three digit mAs display 31 which provides on numerical LEDs 90 the exact mA, which has been automatically set by the unit as discussed above and shown in Tables I and II, multiplied by the exposure time selected by the operator. This value is extremely important to certain operators who are trained to be aware of the level of mAs required for a particular effective X-ray photograph.

The mAs display 31 is achieved using a variable oscillator 92 which is connected to Section C of exposure control switch 29, the construction of which is shown in FIG. 11, and a count enable gate 91 which is connected to kVp select switch 28. In addition, the mAs display circuitry incorporates transistor 93 and various other resistors and capacitors, the values of which are specifically detailed in FIG. 8. In this example, gate 91 is a 555 chip manufactured by Signetics, variable oscillator is a 555 chip manufactured by Signetics, and transistor 93 is a 2N4400. Each of the three digital counters and driver units 90 are RCA 4026.

In operation, variable oscillator 92 operates as a frequency generator. As soon as a signal is generated, variable oscillator 92 will start generating pulses. Simultaneously, counting gate 91 allows counter 90 to count for a specific period of time. Of course, at the end of the tenth count, the numeral will shift from the first to the second LED display.

Since the particular mA deliverable to the X-ray tube depends upon the kVp selected, as well as the exposure time selected, kVp select switch 28 is connected to gate 91 in order to change the gate duration. Once the gate duration has been set, the displayed number changes only by the changing of the frequency. In this way, apparent multiplication is achieved by varying either the frequency or the gate duration.

Main Control Circuitry

Figure 9A:
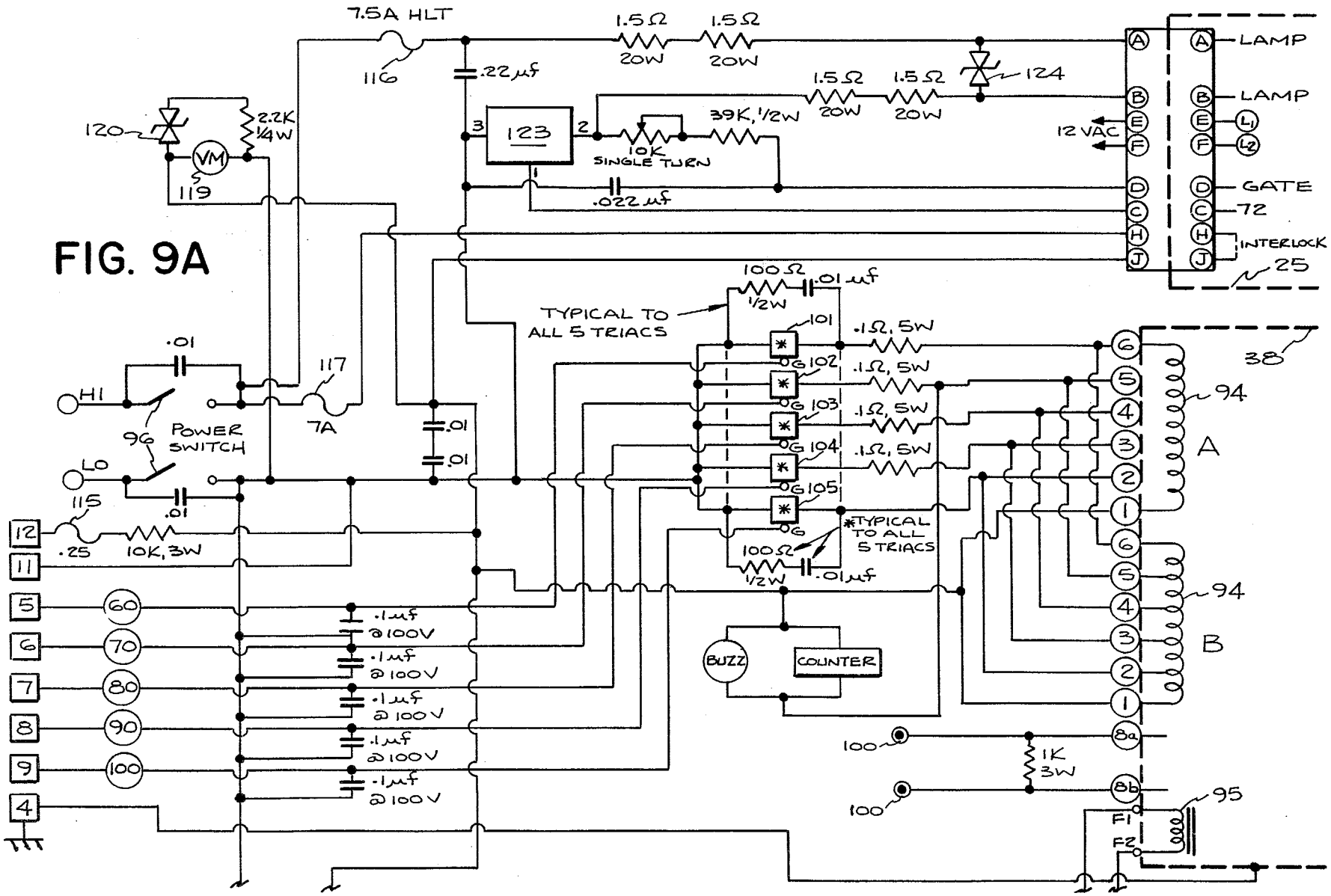
FIG. 9 is a schematic view of the detailed electrical circuitry of the main housing.
Figure 9B:
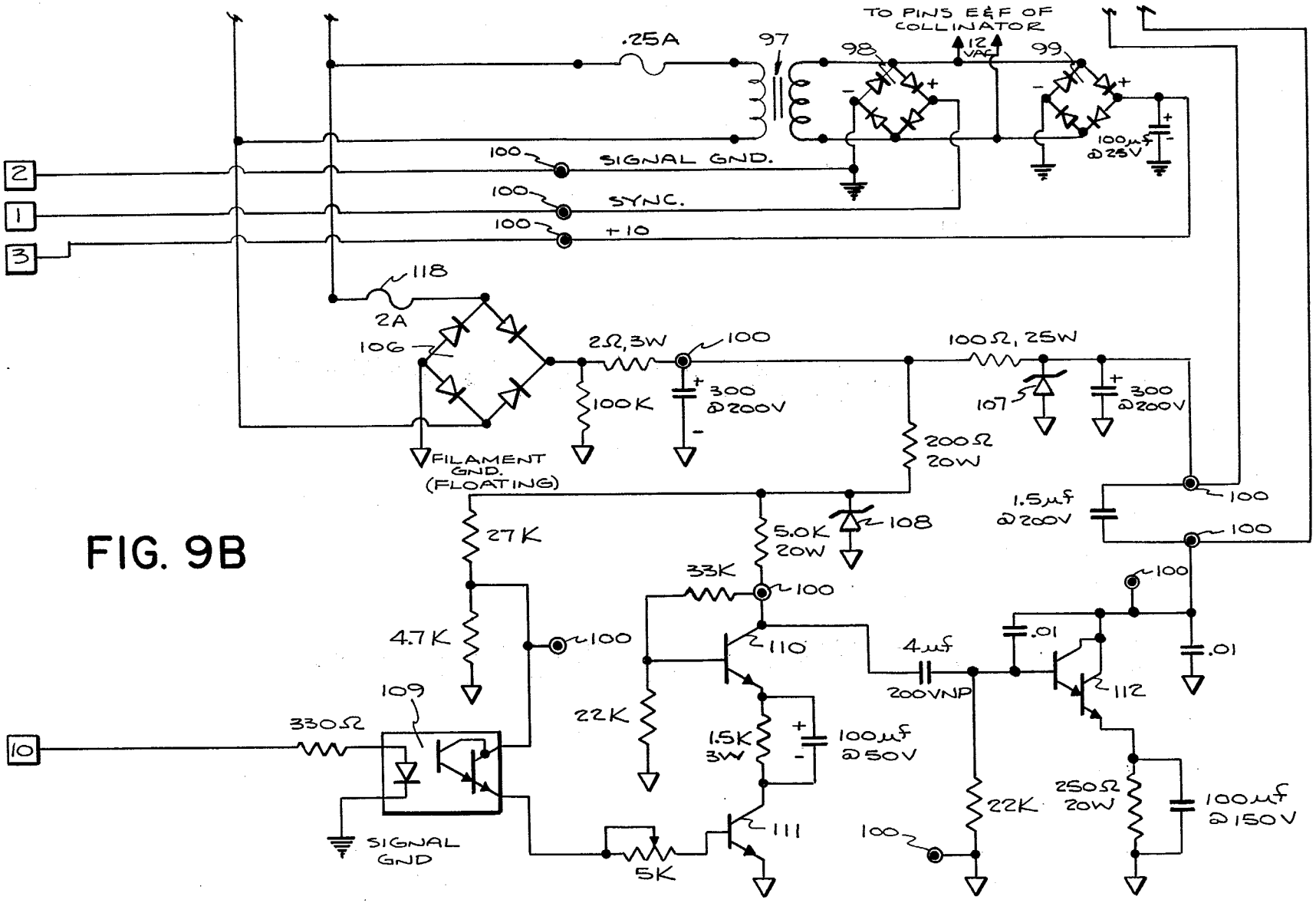

In FIG. 9, which comprises FIGS. 9A and 9B, the detailed electronic circuitry in the main housing is shown. As discussed above, this circuitry receives the command signals from the remote controller and delivers these signals to the primary windings 94 of the high voltage transformer, while also delivering the mA level to the primary windings 95 of the filament transformer.

Power is delivered to the circuitry of the main unit when power switch 96 is closed. As is fully described below, this supplies the power necessary for the high voltage transformer, the filament transformer, the operating current for the remote controller, and the operating power necessary for the pre-focusing lamp of the collimator.

The input power is rectified before being delivered via pins 1, 2 and 3 of connector 23, to the remote controller 22. The rectification circuit incorporates transformer 97 and bridge rectifiers 98 and 99. Bridge rectifier 98 transforms the incoming signal into a varying amplitude DC signal which is delivered on pin 1 of connector 23 to remote controller 22. Bridge rectifier 99 and associated filter capacitor 99' also provide filtering to the output signal which is delivered to remote controller 22 via pin 3 of connector 23.

In order to assure proper operation and quick and easy ability to check the operational circuitry, this rectifying circuit incorporates test points 100 in each of the output lines, in which jacks can be inserted in order to check the line output. Similarly, in order to assure the proper operation of the entire main housing circuitry, test points 100 have been incorporated in many of the lines in the main housing circuitry and, for simplicity, each of these test points has been identified throughout FIG. 9 with the same reference numeral.

The particular kVp level selected by the operator is carried along one of pins 5, 6, 7, 8 or 9 of connector 23 to either triac 101, 102, 103, 104 or 105. Whichever triac receives a signal fires, thereby carrying the high voltage signal to the particular primary windings 94 to produce the pre-selected kVp level.

In order to provide the rapid switching desired for the kVp selected level, triacs are employed. However, although the triacs are extremely fast in operation, they are also sensitive to noise. As a result, sufficient filtering is provided in the circuitry in order to reduce any potential noise interference.

The main housing circuitry also incorporates bridge rectifier 106 and zener diodes 107 and 108 for rectifying voltage regulating, and shaping the incoming power and for driving the primary windings 95 of the filament transformer.

The actual mA level produced by the filament transformer is controlled in remote controller 22 by applying a different frequency signal to the primary windings 95 of the filament transformer to each pre-determined mA level. This variable frequency signal is received in the main control circuitry on pin 10 of connector 23 and delivered to photo Darlington coupler 109. In this example, photo Darlington coupler is manufactured by Monsanto. The output from photo Darlington coupler 109 is transmitted through the remainder of the power amplification circuit which incorporates, along with zener diode 108, transistors 110 and 111 and Darlington 112. In the preferred embodiment, Darlington 112 is a Motorola MJ3042, transistor 110 is a Motorola MJ3202, and transistor 111 is a 2N3440. This power amplifier circuit assures that the frequency control signal generated in the remote controller and delivered on pin 10 of connector 23 is transmitted to primary 95 of the filament transformer in order to provide the desired mA level at the filament of the X-ray tube.

Main circuit breaker 117 for the entire main housing circuitry comprises, in the preferred embodiment, a 7 amp circuit breaker. It has been found that although 12 to 15 amps is being delivered to the high voltage transformers, there is a time constant associated with the high amperage level, with four seconds being the maximum that any particular exposure can be maintained. As a result, a 7 amp circuit breaker provides sufficient protection, since it will automatically open the circuit in about 5 to 10 seconds of continuous operation at 12 to 15 amps.

Consequently, if for some reason the operate button locks on or the operator freezes and doesn't release the operate switch, resulting in a continuous signal being fed to the X-ray tube, circuit breaker 117 will automatically open the circuit preventing any continuous harmful production of X-rays. Main circuit breaker 118 is actuated if the maximum time allocated for the X-ray exposure has elapsed, which indicates a malfunction in the timer control or in the main switching circuits or in operator actions.

In order to be able to check the operating level of the X-ray unit, voltmeter 119 is incorporated into the circuit with a back-to-back zener 120 assisting to clip the signal being received and thereby expanding the scale of the meter. In this example, zener 120 is a 1N1799.

The remainder of the circuitry shown in FIG. 9 details the control system for collimator 25. In order for the operator to be capable of setting the area to which X-rays will be exposed, a very powerful light, typically a 150 watt bulb, is employed. However, the bulb must have a very small focal spot in order to have the focal points of both the X-ray beam and the light beam coincide as closely as possible. In typical prior art systems, a 115 watt, 24 volt, 6 amp supply with 150 watt transformer is employed.

In the circuitry of the present invention, the large cumbersome transformer has been completely eliminated and the voltage to the lamp is controlled by a triac control 123 and two back-to-back zeners 124. With this very compact circuitry, a fraction of the sign wave is picked up and then clipped by the back-to-back zeners. Consequently, the voltage delivered to the lamp is reduced and a 40 volt peak signal to the lamp is assured. This is important since it has been found that the power to the lamp does not cause any difficult but a peak signal in excess of 50 volts causes the filament to open.

As a further safety feature, collimator 25 incorporates an interlock which prevents the system from operating if the collimator is separated from the main housing. Also, to protect the collimator's circuitry, fuse 116 is employed having a 7.5 amp rating.

The remaining components in the circuitry of the main unit which have not been specifically identified in the above description are detailed in the drawing itself.

Figure 10:
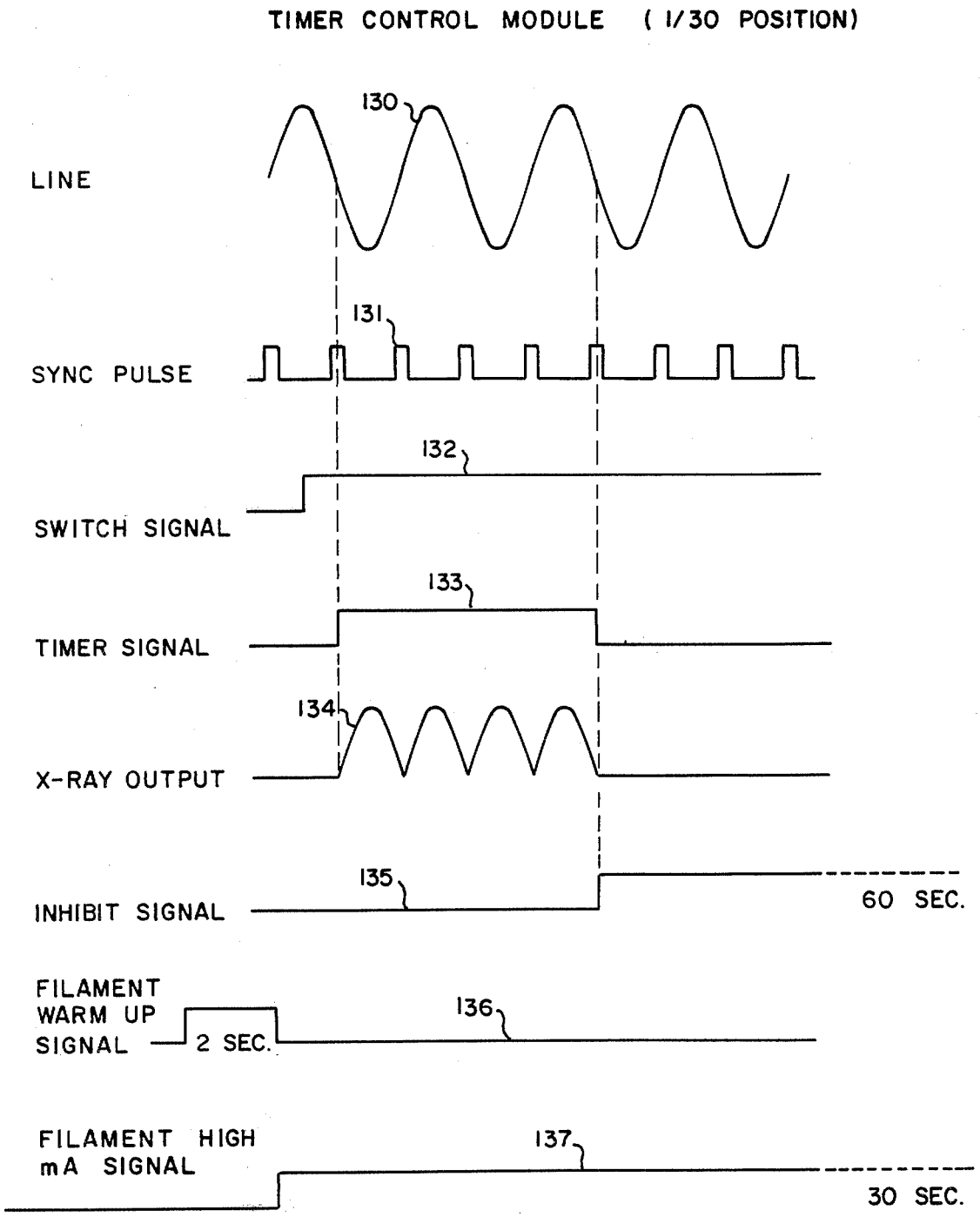
FIG. 10 is a schematic view of the timing sequence of the X-ray unit of the present invention when set for an exposure time of 1/30th of a second.

In FIG. 10, the overall operation of this example of the X-ray unit of the present invention can best be understood by referring to the timing diagram which is representative of the operation of the X-ray unit of the present invention when exposure time switch 29 has been set for 1/30th of a second. Signal 130 represents the AC line voltage delivered to the unit at 60 cycles per second. Synchronization pulse 131 represents the rectified square wave synchronization input to pin 3 of timer chip 66. Signal 132 represents the closure of switch 30 which is operator initiated. Signal 133 is the timer output signal which is controlled by the time set by the operator and shaped to conform with the zero crossover of the AC current. By comparing signal 132 to 133, it becomes clear that although switch 30 may be closed, the actual timer signal delivered to the windings of the high voltage transformer will only be initiated at the precise zero crossover points. As shown by timer signal 130, exposure time of 1/30th of a second represents two complete cycles which is exactly the length that timer signal 133 is on. As soon as the set period of time terminates, timer signal 133 goes to zero.

Corresponding to the precise duration of timer signal 133, X-rays are generated as represented by X-ray output signal 134. As soon as the timer signal 133 is turned off, inhibit signal 135 is turned on at pin 8 of inhibit chip 69 and continues for the fixed time period, in this example 60 seconds, in order to provide sufficient cooling for the X-ray tube.

Further controlling operations which were discussed above is a filament warmup output signal 136 on pin 9 of mA warm-up chip 70 which is high for a fixed time period, in this example 2 seconds, and prevents any X-ray generation until it is turned off. Finally, the high mA signal 137 on pin 16 of mA on chip 71 is turned on when filament warmup signal 136 is turned off. Signal 137 continues for a fixed time period, in this example 30 seconds, and then will go off and stay off until reinitiated by the operator. However, in order to obtain any X-ray generation, signal 137 must be on.

It is believed that by comparing this timing chart with the detailed operation of the circuitry of remote controller 22 and the circuitry in main housing 24, the entire operation and construction of X-ray unit 20 of the present invention is clearly presented for complete and easy understanding by anyone skilled in the art. Furthermore, it is believed that the unique construction of the X-ray unit of the present invention as detailed herein is capable of a wide variety of variations or employment of various portions of the unique construction detailed above. Consequently, all of the variations obvious to one skilled in the art or appropriations of any parts of the unique operations which may then be combined with conventional constructions represent an appropriation of the present invention within the purview of one skilled in the art.

It will best seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A portable X-ray unit comprising (A) a main housing incorporating
- (a) high voltage handling circuitry,
- (b) low voltage handling circuitry,
- (c) high voltage and low voltage interfacing means,
- (d) an X-ray generating tube,
- (e) a high voltage transformer conductively connected to the X-ray tube and the high voltage handling circuitry, and
- (f) a filament transformer conductively connected to the filament of the X-ray tube and the high voltage handling circuitry; and (B) a hand-holdable controller operable at locations remote from the main housing and capable of completely controlling the main housing, incorporating
- (a) low voltage interconnection means conductively connected between the remote controller and the low voltage handling circuitry of the main housing,
- (b) operator controlled switch means for preselecting a desired peak kilovolt level,
- (c) operator controlled switch means for preselecting an exposure time duration,
- (d) current level control circuitry for automatically selecting and delivering a fixed filament current level for the particular pre-selected conditions,
- (e) display means for visually presenting the product of the automatically determined current level multiplied by the pre-selected exposure time,
- (f) informational display means for visually presenting the particular operational state of the main housing, and
- (g) operator controlled exposure initiation switch means for controlling the start of the X-ray exposure.

2. The portable X-ray unit defined in claim 1, wherein the X-ray generating tube, the high voltage transformer, and the filament transformer are housed in a single, sealed container.

3. The portable X-ray unit defined in claim 2, wherein said sealed container comprises heat sink means and expansion bellows contained within the housing for absorbing and safely dissipating heat generated by the transformers contained therein.

4. The portable X-ray unit defined in claim 2, wherein said sealed container is further defined as being removably mounted in the main housing for quick and easy replacement upon any malfunction therein.

5. The portable X-ray unit defined in claim 2, wherein said sealed container is further defined as being controllably connected to the circuitry contained within the main housing.

6. The portable X-ray unit defined in claim 1, wherein said filament transformer is further defined as providing a plurality of different output current levels, each of which is controllably obtained by delivering to the filament transformer a particular input frequency corresponding to the desired output current level.

7. The portable X-ray unit defined in claim 6, wherein the remote controller is further defined as incorporating input frequency generating means having a variable output frequency controllably connected to the peak kilovolt level switch and exposure time switch.

8. The portable X-ray unit defined in claim 7, wherein said input frequency generator is controlled by varying an RC time constant associated therewith.

9. The portable X-ray unit defined in claim 1, wherein said remote controller is further defined as comprising an inhibit signal generator controllably connected to the command signals of the main housing for preventing any repetitive X-ray exposures before a fixed cooling time has elapsed.

10. The portable X-ray unit defined in claim 1, wherein said current level control circuitry is further defined as comprising
- (1) a first timed signal generator conductively connected to the filament transformer and providing a high current level for a fixed period of time,
- (2) automatic switching means for changing from the high current level to a lower standby current level at the expiration of said fixed time, and
- (3) over-ride means for maintaining a high current level at the expiration of the fixed time period when an exposure is in progress.

11. The portable X-ray unit defined in claim 10, wherein the hand-holdable controller is further defined as comprising operator controlled reset switch means for automatically activating the current level control circuitry to initiate the timed signal generator to provide a high current level.

12. The portable X-ray unit defined in claim 10, wherein said current level control circuitry is further defined as comprising
- (4) a second timed signal generator for automatically delaying delivery of a high current level for a fixed period of time, providing sufficient warmup time when high current level is requested.

13. The portable X-ray unit defined in claim 1, wherein said peak kilovolt level switch means is further defined as providing operator controlled selection of peak kilovolt levels between 60 and 100 kilovolts.

14. The portable X-ray unit defined in claim 1, wherein said exposure time duration switch means is further defined as comprising operator controlled exposure times of between 1/120th and 4 seconds.

15. The portable X-ray unit defined in claim 14, wherein said exposure time switch means is further defined as comprising 24 independent settings within said range.

16. The portable X-ray unit defined in claim 1, wherein said exposure initiation switch means is further defined as comprising a deadman switch for automatically stopping X-ray generation upon release thereof.

17. The portable X-ray unit defined in claim 1, as comprising (1) a power ON light connected to the low voltage handling circuitry of the main housing to provide an indication when the main housing incoming power control switch has been turned on, (2) a ready light connected to current level control circuitry for providing a positive indication when a high current level is deliverable, (3) an exposure light providing a positive indication when the controller command signals are operatingly controlling the main unit for providing X-ray generation.

18. The portable X-ray unit defined in claim 1, wherein said display means comprises:

(1) a variable oscillator connected to the exposure time duration switch means and responsive thereto for changing the output frequency, (2) count enable gate connected to the peak kilovolt level switch means and responsive thereto for changing the gate time duration, (3) digital display means controllably connected to the output signals of the counter/driver and (4) count enable gate for creating the numerical product of the automatically selected current level multiplied by the operator selected exposure time duration.

19. The portable X-ray unit defined in claim 1, wherein both the peak kilovolt level switch means and the exposure time duration switch means are further defined as comprising multi-tier switches.

20. The portable X-ray unit defined in claim 1, wherein the operator controlled exposure initiation switch means is further defined as comprising a multi-tier switch.

21. The portable X-ray unit defined in claim 20, wherein one tier of said multi-tier switch is connected to automatically interrupt an X-ray generation signal when said switch is released.

22. The portable X-ray unit defined in claim 1, wherein said high voltage handling circuitry comprises a plurality of solid state switches connected to a plurality of taps of the primary of the high voltage transformer, whereby individual activation of each of said solid state switches produces activation of different transformer windings, achieving a different voltage output level from the transformer for each such activated switch, and the hold-holdable remote controller is further defined as comprising:

(h) activation signal generating means conductively connected to the solid state switches of the main housing for control thereof.

23. The portable X-ray unit defined in claim 22, wherein said activation signal generating means, with said high voltage transformer and said remote controller being connected and synchronized with an alternating current power source, comprises:

(1) a timer signal generator controllably connected to the operator selected exposure time duration switch means, (2) a zero crossing switch connected to receive the output signal from the timer signal generator and said alternating current power source, and adapted to provide an output signal when receiving said output signal from the timer signal generator and synchronized by the zero crossover of the alternating power source, and (3) a triac connected to receive the synchronized output signal from the zero crossing switch and deliver said signal to the operator selected peak kilovolt switch means.

24. The X-ray unit defined in claim 23, wherein said activation signal generating means comprises further:

(4) at least one optical coupler for segregating and controllably delivering the activation signal with a minimum of interference to said high voltage transformer.

25. The portable X-ray unit defined in claim 23, wherein said plurality of solid state switches is further defines as comprising a plurality of triacs.

26. The portable X-ray unit defined in claim 23, wherein said current level control circuitry is further defined as comprising a frequency generator (1) controllably connected to the filament transformer, and (2) producing alternative frequency signals in response to an operator controllable RC time constant.

27. The portable X-ray unit defined in claim 26, wherein the operator controlled peak voltage level switch means is further defined as (1) comprisng a multi-tier, multi-positioned switch, (2) connected at one tier thereof to an input pin of the frequency generator, and (3) having resistors connected to each of the multi-positions of the peak voltage level switch at the tier connected to the frequency generator, for controllably altering the input signal to the switch to a specific, pre-determined, fixed output signal for each of the multi-positions of the peak voltage level switch at said tier.

28. The portable X-ray unit defined in claim 27, wherein the operator controlled exposure time duration switch means is further defined as (1) comprising a multi-tier, multi-position switch, (2) connected at one tier thereof to an input pin of the frequency generator, and (3) having resistors (i) connected to particular positions of the exposure time duration switch at the tier connected to the frequency generator, and (ii) connected in series to the resistors of the peak voltage level control switch, forming a cooperating resistor network, whereby operator selection of any combination of positions of said peak voltage level switch and said exposure time duration switch automatically provides a predetermined, fixed resistor value peculiar to that combination which transforms the incoming signal to the switches into the output signal for delivery to and control of the frequency generator.

29. The X-ray unit defined in claim 28, wherein said frequency generator incorporates a capacitor conductively connected to the output signal from the resistor network of the operator controlled switches, providing individual RC time constants for each combination of operator selectable switch positions.

30. The X-ray unit defined in claim 28, further defined in that the resistor network associated with the peak voltage level switch and exposure time duration switch provides an output signal to the frequency generator for each combination of switch positions which controls and activates the frequency generator to produce individual frequency output signals specifically identifiable with each particular combination of switch positions, and capable of generating in the filament transformer the maximum mA level desirable for the particular selected switch positions.

31. The X-ray unit defined in claim 28, wherein the resistor network controls the frequency generator to produce an output to the filament transformer providing (a) a peak current level of approximately 28 mA when the peak voltage level switch is at 100 kilovolts and the exposure time duration switch is at any position between substantially 1/120th and 0.3 seconds, (b) a peak current level of approximately 23 mA when the peak voltage level switch is at 100 kilovolts and the exposure time duration switch is at any position between substantially 0.4 and 1.8 seconds, (c) a peak current level of approximately 20 mA when the peak voltage level switch is at 100 kilovolts and the exposure time duration switch is at any position between substantially 2.0 and 4.0 seconds, (d) a peak current lwevel of approximately 33 mA when the peak voltage level switch is at 90 kilovolts and the exposure time duration switch is at any position between substantially 1/120th and 0.3 seconds, (e) a peak current level of approximately 26 mA when the peak voltage level switch is at 90 kilovolts and the exposure time duration switch is at any position between substantially 0.4 and 1.8 seconds, (f) a peak current level of approximately 23 mA when the peak voltage level switch is at 90 kilovolts and the exposure time duration switch is at any position between substantially 2.0 and 4.0 seconds, (g) a peak current level of approximately 38 mA when the peak voltage level switch is at between 70 and 80 kilovolts and the exposure time duration switch is at any position between substantially 1/120th and 0.3 seconds, (h) a peak current level of approximately 31 mA when the peak voltage level switch is at between 70 and 80 kilovolts and the exposure time duration switch is at any position between substantially 0.4 and 1.8 seconds, (i) a peak current level of approximately 27 mA when the peak voltage level switch is at between 70 and 80 kilovolts and the exposure time duration switch is at any position between substantially 2.0 and 4.0 seconds, (j) a peak current level of approximately 47 mA when the peak voltage level switch is at 60 kilovolts and the exposure time duration switch is at any position between substantially 1/120th and 0.3 seconds, (k) a peak current level of approximately 37 mA when the peak voltage level switch is at 60 kilovolts and the exposure time duration switch is at any position between substantially 0.4 and 1.8 seconds, (l) a peak current level of approximately 33 mA when the peak voltage level switch is at 60 kilovolts and the exposure time duration switch is at any position between substantially 2.0 and 4.0 seconds.

32. The portable X-ray unit defined in claim 28, wherein said display means is further defined as comprising:

(1) a variable oscillator connected to a second tier of the exposure time duration switch and responsive thereto for changing the output frequency, (2) a count enable gate connected to a second tier of the peak kilovolt level switch and responsive thereto for changing the gate time duration, and (3) digital display means controllably connected to the output signals of the oscillator and the count enable gate for displaying the numerical product of the automatically selected current level multiplied by the operator selected exposure time duration.

33. An X-ray unit for providing controlled X-ray generation for a pre-selected exposure time at a preselected voltage level, said unit comprising A) a main housing incorporating (a) a high voltage transformer (b) a plurality of solid state switches connected to a plurality of taps in the primary of the high volage transformer, whereby individual activation of each of said solid state switches produces activation of different transformer windings, achieving a different voltage output level from the transformer for each such activated switch; and (B) a remote controller conductively connected to the main housing and connected to the high voltage transformer with synchronized alternating current power sources and incorporating an operator controlled multi-positionable switch for transmitting an activation signal to the appropriate solid state switch of the main housing; and (C) activation signal generation means incorporating (a) a timer signal generator controllably connected to the pre-selected exposure time, (b) a zero crossing switch connected to receive the output signal from the timer signal generator and said AC power source, and adapted to provide an output signal when receiving said output signal from the timer signal generator and synchronized by the zero crossover of the AC power sources, and (c) a low powered triac connected to receive the synchronized output signal from the zero crossing switch and deliver said signal to the multi-positionable switch.

34. The X-ray unit defined in claim 33, wherein said activation signal generation means comprises further (d) at least one optical coupler for segregating and controllably delivering said activation signal with a minimum of interference to said high voltage transformer.

35. The X-ray unit defined in claim 33, wherein said low powered triac is contained in the remote controller.

36. The X-ray unit defined in claim 33, wherein the activation signal generation means comprises further (d) a back-to-back LED positioned between the low powered triac and the multi-positionable switch to provide illumination of both halves of the current cycle.

* * * * *

UNITED STATES PATENT AND TRADEMARK OFFICE

CERTIFICATE OF CORRECTION

PATENT NO. : 4,170,735

DATED : October 9,1979

INVENTOR(S) : Jorge G. Codina et al.

It is certified that error appears in the above—identified patent and that said Letters Patent is hereby corrected as shown below:

Column 2, line 64, after "the" delete "moduole" and substitute therefor --module--;

Column 3, line 51, after "the" second occurrence, delete "park" and substitute therefor --peak--;

Column 6, line 57, after "example" delete "operator" and substitute therefor --operate--;

Column 14, lines 66-67, after "the" delete "opera-tion" and substitute therefor --operator--;

Column 21, line 17, after "Claim 1," insert --wherein said informational display means is further defined--;

Column 21, line 64, after "the" delete "hold-holdable" and substitute therefor --hand-holdable--;

Column 22, line 28, delete "defines" and substitute therefor --defined--;

UNITED STATES PATENT AND TRADEMARK OFFICE

CERTIFICATE OF CORRECTION

PATENT NO. : 4,170,735

DATED : October 9, 1979

INVENTOR(S) : Jorge G. Codina et al.

It is certified that error appears in the above—identified patent and that said Letters Patent is hereby corrected as shown below:

Column 22, line 40, after "(1)" delete "comprisng" and substitute therefor --comprising--;

Column 23, line 37, after "current" delete "lwevel" and substitute therefor --level--;

Column 24, line 30, after "high" delete "volage" and substitute therefor --voltage--.

Signed and Sealed this

Seventh Day of April 1981

[SEAL]

*Attest:*

RENE D. TEGTMEYER

*Attesting Officer*

*Acting Commissioner of Patents and Trademarks*